US008584434B2

(12) United States Patent
Kodama et al.

(10) Patent No.: US 8,584,434 B2
(45) Date of Patent: Nov. 19, 2013

(54) MEDICINE PACKING APPARATUS

(75) Inventors: Tsuyoshi Kodama, Toyonaka (JP); Shoji Yuyama, Toyonaka (JP); Nakaji Takeda, Toyonaka (JP); Hiromichi Tsuda, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 215 days.

(21) Appl. No.: 12/311,068

(22) PCT Filed: Sep. 19, 2007

(86) PCT No.: PCT/JP2007/068163

§ 371 (c)(1),
(2), (4) Date: May 4, 2009

(87) PCT Pub. No.: WO2008/035701

PCT Pub. Date: Mar. 27, 2008

(65) Prior Publication Data

US 2010/0018986 A1 Jan. 28, 2010

(30) Foreign Application Priority Data

Sep. 20, 2006 (JP) ..... 2006-254966
Apr. 2, 2007 (JP) ..... 2007-096926

(51) Int. Cl.
*B65B 5/04* (2006.01)

(52) U.S. Cl.
USPC ..... 53/246; 53/266.1; 53/235; 53/248

(58) Field of Classification Search
USPC ..... 53/266.1, 267, 284.1, 235, 239, 241, 53/246, 247, 248, 250, 52, 75, 539, 53/473.474
See application file for complete search history.

(56) References Cited

U.S. PATENT DOCUMENTS 4,685,271 A * 8/1987 Ringer et al. ..... 53/246
4,693,371 A * 9/1987 Malpass ..... 206/538
5,351,818 A * 10/1994 Daneshvar ..... 206/216

(Continued)

FOREIGN PATENT DOCUMENTS

JP 10-323382 12/1998
JP 2866543 3/1999

(Continued)

OTHER PUBLICATIONS

Patent Cooperation Treaty (PCT) International Preliminary Report on Patentability, issued Mar. 24, 2009.

(Continued)

*Primary Examiner* — Alexandra Elve
*Assistant Examiner* — Eyamindae Jallow
(74) *Attorney, Agent, or Firm* — Wenderoth, Lind & Ponack, LLP

(57) ABSTRACT

A tablet supply unit (2) of a medicine packing apparatus (1) has a tablet housing section (22*c*) including tablet housing chambers (21) for respectively housing the tablets for one dose fed from upper end openings thereof. The tablet housing chambers (21) are arranged in a plurality of rows in an antero-posterior direction and a plurality of columns in a lateral direction. A closing cover (25) opens upper end openings (21*a*) of all of the tablet housing chambers (21) at an open position and closes the upper end openings (21*a*) in one or more rows of the tablet housing chambers on a rear side among the tablet housing chambers at a closed position.

8 Claims, 37 Drawing Sheets

(56) References Cited

U.S. PATENT DOCUMENTS

| | | | | |
|---|---|---|---|---|
| 6,779,663 | B1 * | 8/2004 | Pocsi | 206/534 |
| 6,925,774 | B2 * | 8/2005 | Peterson | 53/152 |
| 7,426,814 | B2 * | 9/2008 | Knoth | 53/473 |
| 7,450,202 | B2 * | 11/2008 | Tsuchiya | 349/114 |
| 7,500,337 | B2 * | 3/2009 | Yuyama et al. | 53/131.2 |
| 7,530,213 | B2 * | 5/2009 | Barrett et al. | 53/531 |
| 7,779,614 | B1 * | 8/2010 | McGonagle et al. | 53/474 |
| 7,784,244 | B2 * | 8/2010 | Siegel | 53/246 |
| 7,818,950 | B1 * | 10/2010 | McGonagle et al. | 53/474 |
| 7,861,495 | B2 * | 1/2011 | Yuyama et al. | 53/246 |
| 7,886,506 | B2 * | 2/2011 | Knoth et al. | 53/475 |
| 7,950,202 | B2 * | 5/2011 | Kodama et al. | 53/247 |
| 7,971,414 | B1 * | 7/2011 | McGonagle et al. | 53/246 |
| 7,971,727 | B2 * | 7/2011 | Gnann et al. | 209/391 |
| 2008/0314002 | A1 * | 12/2008 | Yuyama et al. | 53/531 |
| 2009/0044489 | A1 * | 2/2009 | Siegel | 53/247 |
| 2010/0018986 | A1 | 1/2010 | Kodama et al. | |

FOREIGN PATENT DOCUMENTS

| | | |
|---|---|---|
| JP | 11-197216 | 7/1999 |
| JP | 2002-238980 | 8/2002 |
| JP | 2004-083097 | 3/2004 |
| JP | 2004-115059 | 4/2004 |
| JP | 2004-203433 | 7/2004 |
| JP | 2006-115970 | 5/2006 |
| JP | 2006-151399 | 6/2006 |
| WO | 2008/035701 | 3/2008 |

OTHER PUBLICATIONS

International Search Report issued Nov. 27, 2007 in the International (PCT) Application of which the present application is the U.S. National Stage.

* cited by examiner

MEDICINE PACKING APPARATUS

BACKGROUND OF THE INVENTION

1. Technical Field

The present invention relates to a medicine packaging apparatus for packaging solid medicines in non-powder form, such as tablets in a narrow sense, capsules, and pills.

2. Description of the Related Art

Medicine packaging apparatuses for packaging tablets for each one dose with a package sheet based upon information shown in a medical prescription have been variously provided and used in medical institutions such as hospitals and dispensing pharmacies. Such medicine packaging apparatuses include those having a function of supporting a so-called manual distribution operation of the tablets (e.g. refer to Patent Documents 1 to 3). Specifically, a plurality of tablet housing chambers are arranged in matrix form on an upper side of the apparatus, and an operator manually feeds tablets into these tablet housing chambers. In the vicinities of the respective tablet housing chambers, numbers corresponding to an order of packaging are indicated. The operator performs the manual distribution operation referring to these numbers and dosaging times indicated in a medical prescription. Upon completion of the feeding, a shutter constituting bottoms of the tablet housing chambers is opened, resulting in that the tablets inside the respective tablet housing chambers drop into corresponding tablet discharging chambers provided in a movable medicine discharge section. The tablets inside the tablet discharging chambers are sequentially supplied to the packaging apparatus. The configurations of the shutter and the medicine discharge section are disclosed for example in Patent Documents 4 and 5.

As the above-described matrix-manner arrangement of the tablet housing chambers, typically, three or six (a multiple number of three) tablet housing chambers that correspond to a three times daily dosage (e.g. taking a certain medicine three times a day, in the morning, afternoon, and evening) are arranged in an anteroposterior direction (row direction) seen from an operator who performs the manual distribution operation, and a plurality of (e.g. seven, corresponding to the number of days of a week, or a multiple number thereof tablet housing chambers are arranged in a lateral direction (column direction) seen from the operator (refer to Patent Document 1). However, when this typical matrix-manner arrangement is adopted, in a case where the dosaging times described in the medical prescription are other than a multiple number of three, namely in a case of two times daily dosage (e.g. taking a certain medicine twice a day, in the morning and evening) or in a case of four times daily dosage (e.g. taking a certain medicine four times a day, in the morning, afternoon, evening, and at bed time), positions of tablet housing chambers into which specific tablets are to be fed vary among the respective column. This may result in significant deterioration in operability, causing feeding errors.

Patent Documents 2 and 3 propose a configuration provided with a guiding means such as an indicator or an LED lamps to support the manual distribution operation. However, such guiding means requires relatively complicated control accompanied by processing of electric signals based on such information as dosaging times shown in an inputted medical prescription, thereby increasing cost.

When being opened, the above-mentioned shutter is receded to rear sides of partition walls for partitioning adjacent tablet housing chambers. In other words, the partition walls between the tablet housing chambers are necessary to have enough size (widths in a plane view) so as to hide the shutter. However, the partition walls having such large size causes that reduction in size of the medicine packaging apparatus cannot be realized.

[Patent Document 1] Japan Patent Application Laid-open Publication No. 10-323382

[Patent Document 2] Japanese Patent No. 2866543

[Patent Document 3] Japan Patent Application Laid-open Publication No. 2004-203433

[Patent Document 4] Japan Patent Application Laid-open Publication No. 2004-115059

[Patent Document 5] Japan Patent Application Laid-open Publication No. 2004-83097

SUMMARY OF THE INVENTION

Problems to be Solved by the Invention

An object of the present invention is to support a manual distribution operation in a simple configuration and to also reduce a size of a partition wall between tablet chambers in a medicine packaging apparatus.

Means for Solving the Problems

The term "tablet" here is not restricted to a tablet in a narrow sense, but includes solid medicines in non-powder form such as a capsule and a pill.

The present invention provides a medicine packaging apparatus, comprising: a tablet supply section for supplying tablets one-by-one dose; and a packaging section for packaging the tablets supplied from the tablet supply section, wherein the tablet supply section comprises: a tablet housing section provided with tablet housing chambers for respectively housing the tablets for one dose fed from upper end openings thereof, the tablet housing chambers being arranged in a plurality of rows in an anteroposterior direction and a plurality of columns in a lateral direction, a medicine discharge section for taking out the tablets housed in the respective tablet housing chambers and sending the tablets one-by-one dose to the packaging section, and at least one manual distribution supporting member which is manually movable to a first position where the member is receded from the tablet housing section and to a second position where the member is placed on the tablet housing section and which functions to support an operation of feeding the tablets into the tablet housing chambers in accordance with dosaging times per day at the second position.

For example, the tablet housing section further comprises a rotation supporting mechanism which is arranged on a rear side of a rearmost-side row of the tablet housing chambers and which rotatably supports a base end side of the manual distribution supporting member, and the manual distribution supporting member is adapted to be rotated around the rotation supporting mechanism so as to be manually movable between the first and second positions.

The manual distribution supporting members rotatably supported by the rotation supporting mechanism is movable from the first position to the second position, or reversely, by a simple manual operation.

Specifically, the manual distribution supporting member opens upper end openings of all of the tablet housing chambers at the first position, and closes the upper end openings of the tablet housing chambers in one or more rows on a rear side of the tablet housing chambers among the tablet housing chambers at the second position.

When the manual distribution supporting member is set at the second position, it is possible to feed the tablets only into the tablet housing chambers constituting one or more front-side rows with the upper end openings thereof not closed by the manual distribution supporting member among the plurality of tablet housing chambers, and then the tablets housed in each of these tablet housing chambers are sent to the packaging section one-by-one dose. On the other hand, when the manual distribution supporting member is set at the first position, it is possible to feed the tablets into all of the tablet housing chambers, and then the tablets housed in each of all of the tablet housing chambers are sent to the packaging section one-by-one dose.

More specifically, the tablet housing chambers are arranged in four rows in the anteroposterior direction, and the manual distribution supporting member closes the upper end openings of the tablet housing chambers in the rearmost-side row among the four rows at the second position.

With this arrangement, when the manual distribution supporting member is set at the second position, it is possible to feed tablets into the tablet housing chambers constituting three rows in the anteroposterior direction and a plurality of columns in the lateral direction, and house the tablets therein. Accordingly, when the manual distribution supporting member is set at the second position, in a case of the dosaging times being a multiple number of three, namely in the case of three times daily (morning, afternoon, evening) dosage, it is possible to execute the operation of manually distributing the tablets into the respective tablet housing chambers in efficient and reliable manner without causing a feeding error. On the other hand, when the manual distribution supporting member is set at the first position, it is possible to feed tablets into the tablet housing chambers in four longitudinal rows and a plurality of lateral column, and house the tablets therein. Accordingly, when the manual distribution supporting member is set at the first position, in a case of the dosaging times being a multiple number of two, namely two times daily (morning, evening) dosage or four times daily (morning, afternoon, evening, bed time) dosage, it is possible to execute the operation of manually distributing the tablets into the respective tablet housing chambers in efficient and reliable manner without causing the feeding error.

Preferably, the medicine packaging apparatus further comprises a first sensor which becomes an ON state when the manual distribution supporting member is at the second position, and becomes an OFF state when the manual distribution supporting member is at the first position, a second sensor that becomes the OFF state when the manual distribution supporting member is at the second position, and becomes the ON state when the manual distribution supporting member is at the first position, and a control section which inhibits the medicine discharge section from starting an operation when both of the first and second sensors are in the ON state, or both of the first and second sensors are in the OFF state.

When the manual distribution supporting member is at an unstable position, not being completely set either at the first position or the second position, or when a failure has occurred in at least one sensor, the medicine discharge section is inhibited from starting its operation. Therefore, in a case of the tablets being housed in the respective tablet housing chambers in the unstable mode or in a case of failure of sensor being occurred, it is possible to reliably prevent the tablets from being erroneously packaged in the packaging section.

Alternatively, the manual distribution supporting member comprises a plurality of opening portions which are respectively communicated with the upper end openings of the tablet housing chambers so as to permit passage of the tablets when the manual distribution supporting member is at the second position, and a plurality of indicating sections which are respectively provided adjacent to the respective opening sections so as to visually indicate information on the dosaging times per day.

When the manual distribution supporting member is set at the second position, the indicating sections provided adjacently to the opening sections of the manual distribution supporting member visually indicate which tablet housing chambers the tablets are to be fed into in accordance with the dosaging times per day.

For example, the indicating section indicates the dosaging times by colors, patterns, symbols, letters, numbers, or combinations of two or more of them.

Preferably, the manual distribution supporting member includes at least first and second manual distribution supporting members, the first manual distribution supporting member has three kinds of the indicating sections corresponding to a three times daily dosage, and the second manual distribution supporting member has four kinds of the indicating sections corresponding to a four times daily dosage.

When the first manual distribution supporting member is set at the second position, it is possible to execute the operation of manually distributing the tablets into the respective tablet housing chambers in the case of the three times daily dosage in efficient and reliable manner without causing the feeding error. On the other hand, when the second manual distribution supporting member is set at the second position, it is possible to execute the operation of manually distributing the tablets into the respective tablet housing chambers in the case of the four times daily dosage in efficient and reliable manner without causing the feeding error.

The tablet housing section comprises a plurality of first partition walls for partitioning the tablet housing chambers adjacent in a column direction, and a plurality of second partition walls for partitioning the tablet housing chambers adjacent in a row direction. The tablet housing chambers respectively comprises lower end openings on opposite sides to the upper end openings. The medicine discharge section comprises a first shutter plate arranged under the tablet housing section and a second shutter plate arranged under the first shutter plate as superimposed thereon. A plurality of tablet passage holes respectively corresponding to the tablet housing chambers are formed in the first and second shutter plates. The tablet passage holes is defined by first partition sections extending in the row direction of the tablet housing chambers and second partition sections extending in the column direction of the tablet housing chambers. The first and second shutter plates are movable in the column direction of the tablet housing chambers between a retaining position and an open position. Displacement to the retaining position causes that the lower end openings of the tablet housing chambers are respectively closed by the first partition sections of the first shutter plate or the first partition sections of the second shutter plate. Displacement to the open position causes that the first partition sections of the first shutter plate are receded to lower sides of the first partition walls of the tablet housing section and that the first partition sections of the second shutter are receded to lower sides of the first partition sections of the first shutter plate, resulting in that the tablet passage holes of the first and second shutter plates are opposed to the lower end openings of the respective tablet housing chambers.

When the first and second shutter plates are at the retaining position, the tablet passage holes are closed by the second partition sections of the first and second shutter plates, and hence the tablets are held inside the tablet housing chambers. When the first and second shutter plates are at the open position, the tablet passage holes of the first and second shutter plates become opposed to the lower end openings respectively, and hence the lower end openings are opened and the tablets inside the tablet housing chambers drop into the medicine discharge section. Since the lower end openings are closed in the first partition sections of the two shutter plates, namely the first and second shutter plates, the widths of the first partition sections of the respective first and second shutter plates can be set narrow. Therefore, the widths of the first partition wall sections of the tablet housing section to which the first partition sections are receded at the open position can be set narrow, resulting in that the size of the tablet supply section can be reduced and reduction in size of the medicine packaging apparatus as a whole also can be achieved.

Effects of the Invention

Since the medicine packaging apparatus according to the present invention has the manual distribution supporting member that functions to support the operation of feeding the tablets into the tablet housing chambers in accordance with dosaging times per day when it is set at the second position arranged over the tablet housing section, it is possible to execute the operation of manually distributing the tablets into the respective tablet housing chambers in accordance with the dosaging times in efficient and reliable manner without causing the feeding error. Further, the configuration where the lower end openings of the tablet housing chambers are closed by the partition sections of the two shutter plates allows to set the widths of the partition walls of the tablet housing section, to which the partition sections are receded at the open position, narrow. This results in that the size of the tablet supply section can be reduced and reduction in size of the medicine packaging apparatus as a whole also can be achieved.

DESCRIPTION OF REFERENCE SIGNS

1:Medicine packaging apparatus, 2:Tablet supply unit, 3:Powdered medicine supply unit, 4:Packaging unit, 5:Medicine discharge section, 6:Housing, 7:Housing space, 8:Cover, 9:Control panel, 9*a*:Tablet button, 9*b*:LED, 9*c*:Number-of-packs indicating section, 9*d*:Start button, 11, 12, 13:Controller, 21:Tablet housing chamber, 21*a*:Upper end opening, 21*b*:Lower end opening, 22:Tablet housing section, 23:Tablet discharging section, 24*a*, 24*b*:Partition wall, 25:Closing cover, 26:Protection cover, 27, 28, 29, 30:Sensor, 27*a*, 28*a*:Magnetic body, 27*b*, 28*b*: Sensor body, 32:Display, 34:Upper shutter plate, 34*a*: Engaging section, 35:Lower shutter plate, 35*b*:Engaging section, 36:Discharging member, 37:Fixing plate 38, 39:Partitioning section, 41:Tablet passage hole, 42:Tablet discharging chamber, 43:Bottom plate, 44:Pin, 45:Weight, 48:Dropping port, 51:V-chamber, 61:Package sheet, 62:Roll, 63:Sheet supply section, 65:Unfolding guide, 67:Hopper, 67*a*:Feed port, 68:Heat sealing section, 69:Printing section, 71:Holding frame, 71*a*:Front holding section, 71*b*:Side holding section, 72:Hinge mechanism, 73*a*, 73*b*:Guide roller, 75:Ink ribbon, 76:Ink cartridge, 77:Biasing roller, 78:Thermal transfer head, 79:Backup roller, 81:Guide rod, 82*a*, 82*b*:Feed roller, 83*a*, 83*b*:Heater roller, 84:Feed heat sealing member, 85:Roller member, 86:Longitudinal heat sealing member, 90*a*, 90*b*:Unfolding guide surface, 91:Guide body, 92:Bracket, 93:Fixing section, 93*a*, 93*b*:Through hole, 94:Main edge line, 95:Sub-edge line, 96*a*, 96*b*:Top surface 97*a*, 97*b*:Rear end edge, 98:Closing plate, 99*a*, 99*b*:Curved surface, 100A, 100B: Pin mechanism, 101, 102:Number-of-packs indicating section, 111, 112:Closing cover, 112*a*:Base section 112*b*, 112*c*:Extending section, 112*d*:Closing section, 113:Opening, 121:Closing cover, 121*a*:Opening section, 121*b*:Closing section 123, 124:Number indicating section, 201A, 201B, 201C:Manual distribution sheet, 201*a*: Opening, 201*b*:Window, 201*c*:Tab, 202, 203, 204:Number indicating section

DETAILED DESCRIPTION OF THE INVENTION

First Embodiment

Figure 1:
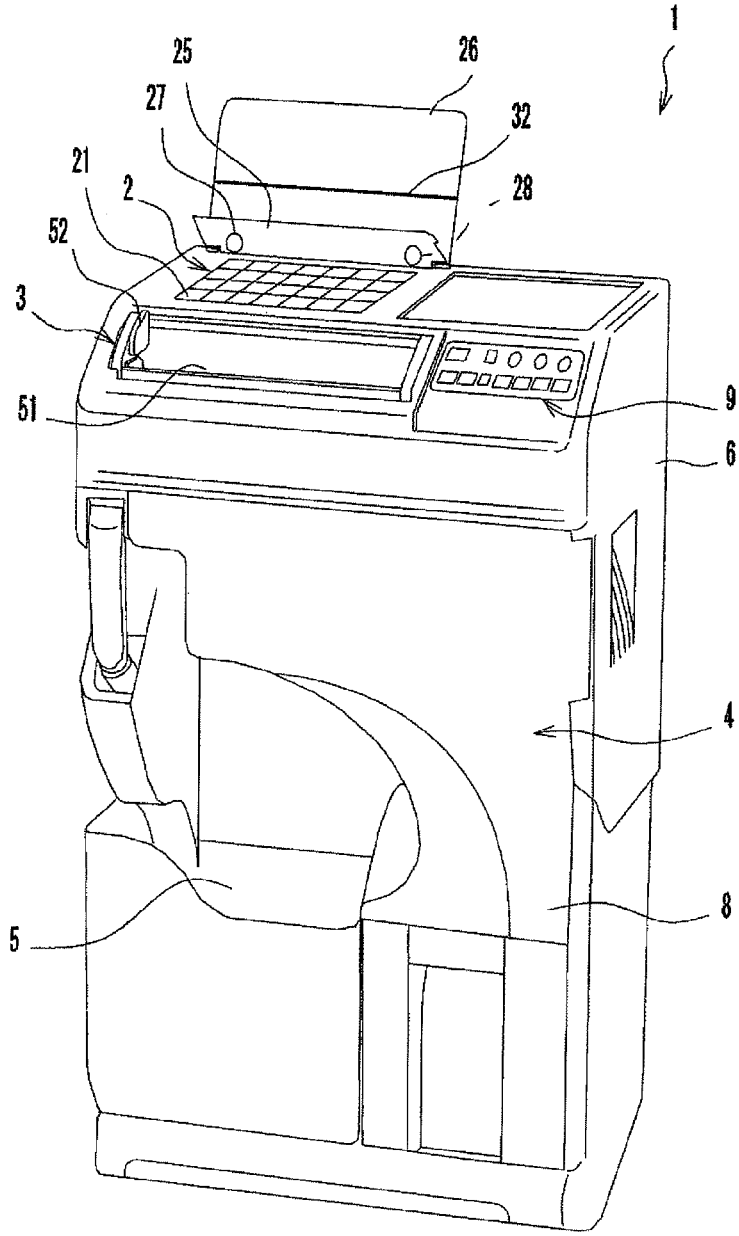
FIG. 1 is a perspective view seen from a front side showing an appearance of a medicine packaging apparatus according to an embodiment of the present invention (a closing cover is at an intermediate position between a closed position and an open position)
Figure 2:
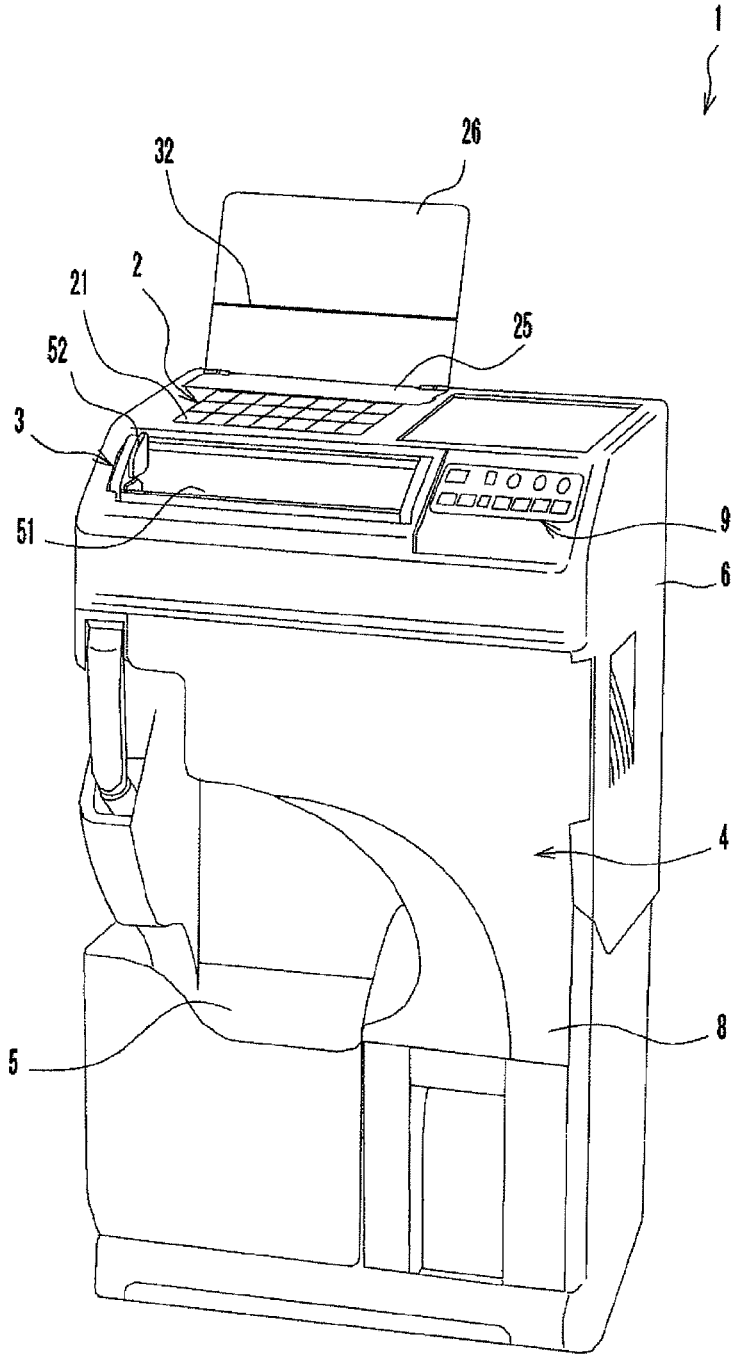
FIG. 2 is a perspective view seen from the front side showing the appearance of the medicine packaging apparatus according to the embodiment of the present invention (the closing cover is at the closed position)

FIGS. 1 and 2 show a medicine packaging apparatus 1 according to an embodiment of the present invention.

(Entire Configuration)

The medicine packaging apparatus 1 includes a tablet supply unit 2, a powdered medicine supply unit 3, a packaging unit 4, and a medicine discharge section 5 from which packaged medicines are discharged. The tablet supply unit 2 and the powdered medicine supply unit 3 are provided on an upper side of a housing 6. Meanwhile, the packaging unit 4 is arranged in the housing space 7 inside the housing 6. An opening on the front surface of the housing 6 is covered by an openable and closable cover 8 in the shape of a single swinging door except for the medicine discharge section 5. When opening this cover 8, an operator can access the packaging unit 4 inside the housing space 7. The form of the cover 8 is not particularly limited, and another form such as a double leaf form may be employed.

Figure 3:
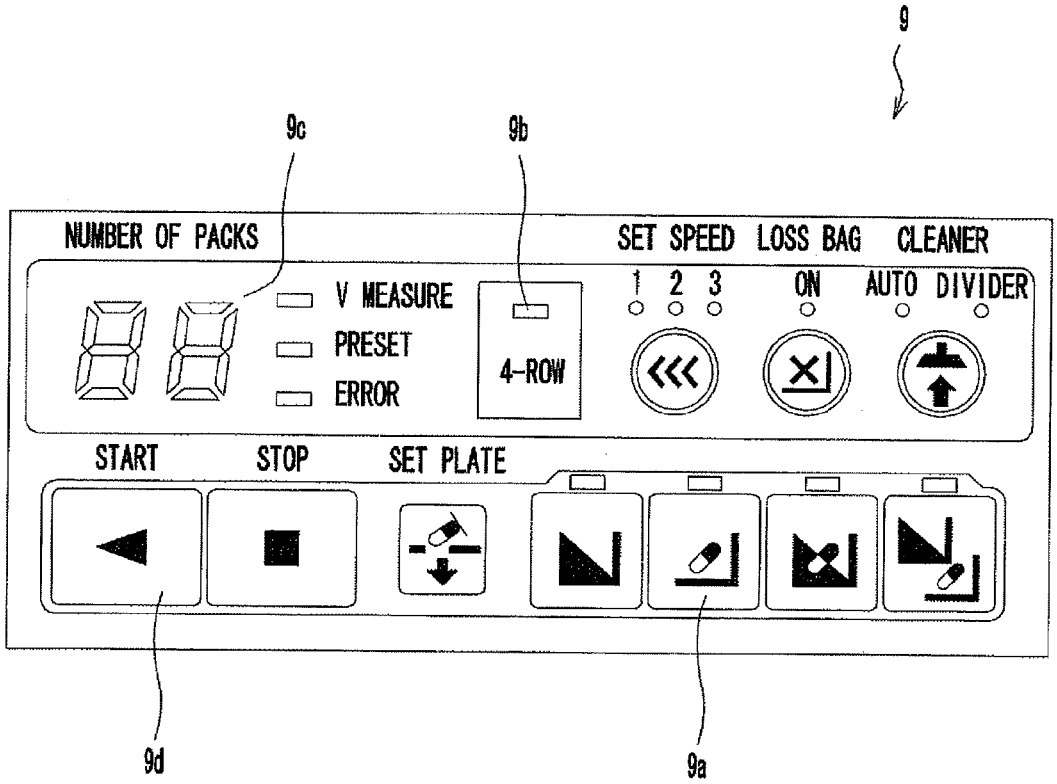
FIG. 3 is a front view of a control panel.
Figure 4:
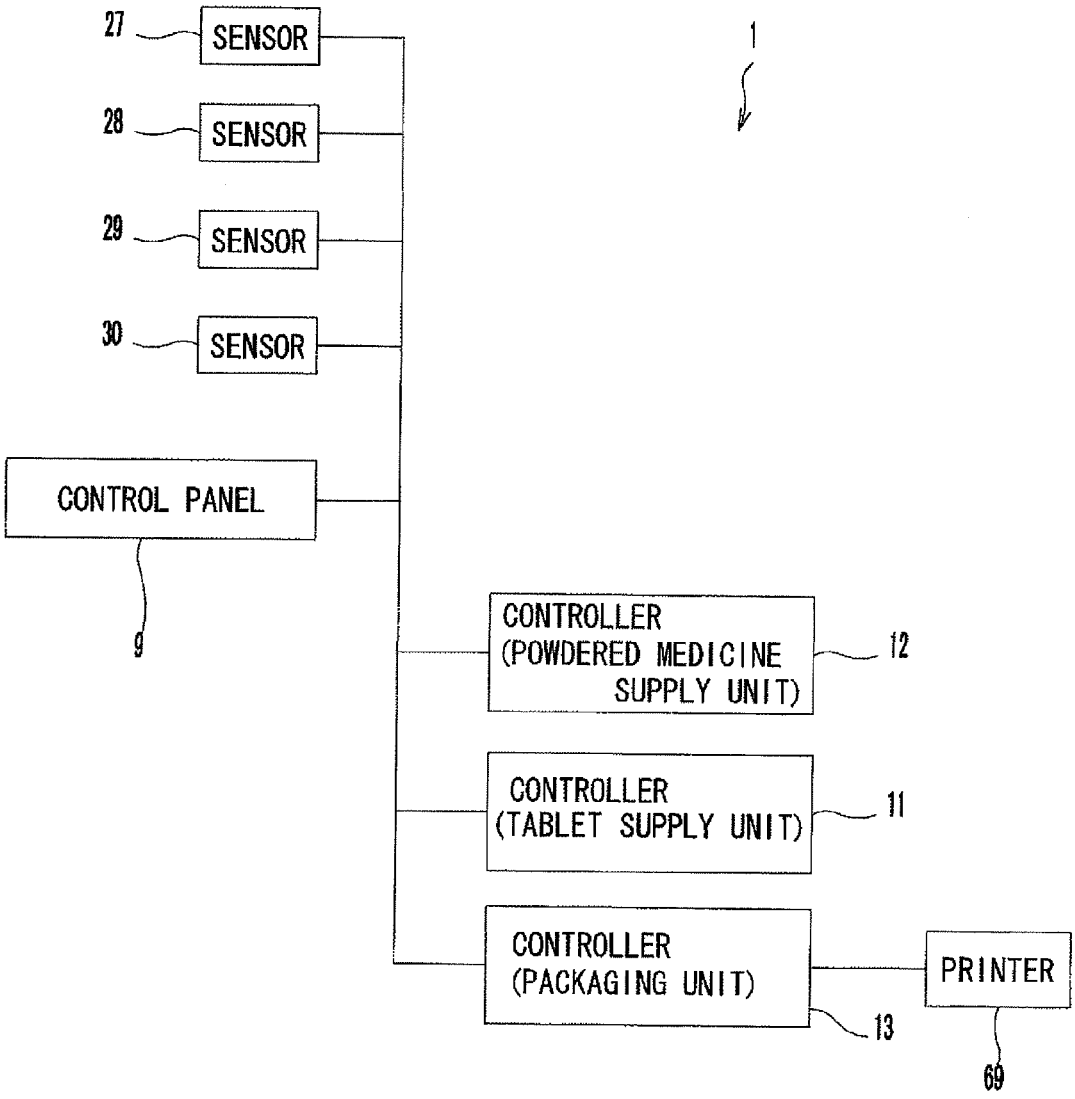
FIG. 4 is a block diagram showing a configuration of the medicine packaging apparatus according to the embodiment of the present invention.

On the upper surface of the housing 6, a control panel 9 shown in FIG. 3 is provided. With further reference to FIG. 4, operations of the tablet supply unit 2, the powdered medicine supply unit 3 and the packaging unit 4 are controlled by controllers 11, 12, and 13 based upon inputs from the control panel 9, inputs of later-described sensors 27, 28 attached to a closing cover (manual distribution supporting member) 25, and inputs of other sensors 29, 30.

(Tablet Supply Unit)

In the following, the tablet supply unit 2 is described with reference to FIGS. 1 to 11. First, with reference to FIGS. 5A to 5C, the tablet supply unit 2 includes a fixed tablet housing section 22 in which a plurality of tablet housing chambers 21 are provided in matrix form (and which constitutes part of the upper side of the housing 6 in the present embodiment) and a tablet discharging section 23 that automatically and sequentially takes out tablets for each dose which were supplied by manual distribution into the respective tablet housing chamber 21, and supplies the tablets to the packaging unit 4.

With reference to FIGS. 1, 2, 6 and 7, the tablet housing section 22 in the present embodiment is provided with a total of 28 tablet housing chambers 21 in an identical shape in four rows in an anteroposterior direction (row direction) and seven columns in a lateral direction (column direction). The tablet housing section 22 includes a plurality of first partition walls 24*a* for partitioning the tablet housing chambers 21 adjacent in the column direction and a plurality of second partition walls 24*b* for partitioning the tablet housing chambers 21 adjacent in the row direction. The respective tablet housing chambers 21 are defined by these first and second partition walls 24*a*, 24*b*. Both the upper and lower ends of the respective tablet housing chambers 21 are open. An upper end opening 21*a* functions as an opening for the operator to manually feed tablets into the tablet housing chambers 21. A lower end opening located on the opposite side to the upper end opening 21*a* functions as an opening through which the tablets housed inside the tablet housing chambers 21 pass to the tablet discharging section 23.

Figure 6:
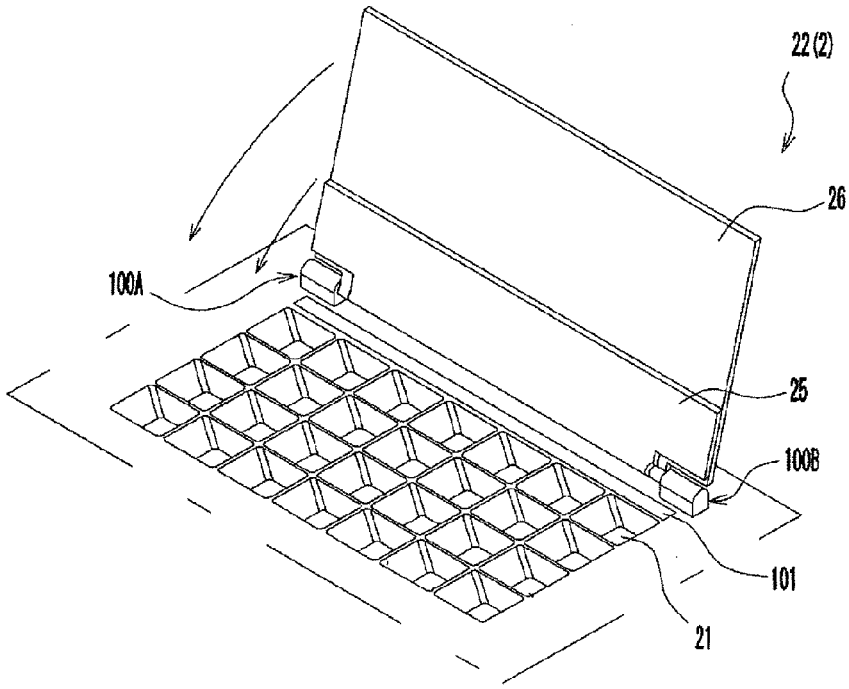
FIG. 6 is a perspective view showing a tablet housing section.
Figure 7:
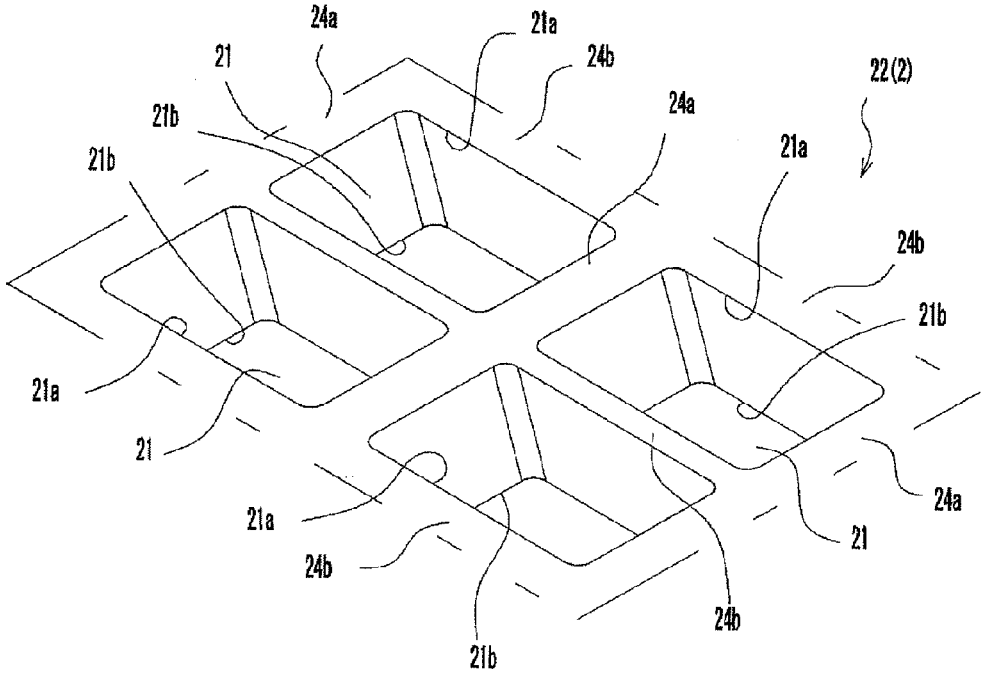
FIG. 7 is a partially expanded view of FIG. 6.

With reference to FIGS. 1, 2 and 6, the tablet housing section 22 includes a closing cover 25 generally in sheet shape or plate shape (manual distribution supporting member) and a protection cover 26 also having generally sheet shape or plate shape. The closing cover 25 and the protection cover 26 are rotatably fixed to the upper surface of the tablet housing section 22. Specifically, two pin mechanisms (rotation supporting mechanisms) 100A, 100B are provided on the further rear side of the rearmost-side tablet housing chambers 21, and base end sides of the closing cover 25 and the protection cover 26 are rotatably supported by these pin mechanisms 100A, 100B. The closing cover 25 is arranged on the nearer side than the protection cover 26 so as to be located below the protection cover when both the closing cover 25 and the protection cover 26 are closed (refer to FIG. 8A).

When the protection cover 26 is at an open position, the closing cover 25 is movable to an open position (FIGS. 8B and 9A) where the closing cover 25 is receded from the tablet housing section 22 and to a closed position (FIGS. 8C, 9B) where the closing cover 25 is placed on the tablet housing section 22. As shown in FIGS. 8B and 9A, when the closing cover 25 is at the open position, the upper end openings 21*a* of all of the 28 tablet housing chambers 21 are opened so that the tablets can be fed into all of the tablet housing chambers 21. On the other hand, as shown in FIGS. 8C and 9B, when the closing cover 25 is at the closed position, the upper end openings 21*a* of the seven tablet housing chambers 21 constituting the rearmost-side one row among the four rows and seven columns of the tablet housing chambers 21 are closed by the closing cover 25. As a result, the tablets can be fed only into a total of 21 tablet housing chambers 21 in three rows and seven columns. In other words, the width of the closing cover 25 is set so as to close the tablet housing chambers 21 in the rearmost-side row at the closed position.

When the closing cover 25 is set at the closed position (FIGS. 8C and 9B), the tablets can be housed in the tablet housing chambers 21 in three rows and seven columns (21 chambers in total), and thereby in a case of dosaging times being a multiple number of three, namely in the case of three times daily (morning, afternoon, evening) dosage, it is possible to execute the operation of manually distributing the tablets into the respective tablet housing chambers 21 in efficient and reliable manner without causing feeding error. On the other hand, when the closing cover 25 is set at the open position (FIGS. 8B and 9A), the tablets can be housed in the tablet housing chambers 21 in four rows and seven columns (28 chambers in total), and thereby in a case of the dosaging times being a multiple number of two, namely in the case of two times daily (morning, evening) dosage or four times daily (morning, afternoon, evening, bed time) dosage, it is possible to execute the operation of manually distributing the tablets into the respective tablet housing chambers 21 in efficient and reliable manner without causing feeding error.

With reference to FIG. 9A, on the upper surface of the tablet housing section 22, a first number-of-packs indicating section 101 is provided on the rear side of the rearmost-side row of the tablet housing chambers 21 (the front sides of the pin mechanisms 100A, 100B). Further, with reference to FIG. 9B, on the upper surface of the closing cover 25, a second number-of-packs indicating section 102 is provided in the vicinity of the front end thereof. As conceptually indicated by chain double-dashed lines in FIGS. 9A and 9B, in the operation of manually distributing the tablets, the tablets are typically fed sequentially in the row direction from the tablet housing chamber 21 in the rightmost-side column and the front-side (nearest-side) row toward the rear side (back side). When the tablets are fed into the tablet housing chambers 21 in this order, the number of packs in a case of feeding the tablets into all of the tablet housing chambers 21 (four chambers in FIG. 9A, and three chambers in FIG. 9B) constituting each of the columns is indicated in the number-of-packs indicating sections 101, 102. Specifically, multiple numbers of four, from 4 to 28, are indicated in the number-of-packs indicating section 101 on the upper surface of the tablet housing section 22, and multiple numbers of three, from 3 to 21, are indicated in the number-of-packs indicating section 102 on the upper surface of the closing cover 25. Referring to these number-of-packs indicating sections 101, 102 can further enhance efficiency of the manual distribution operation, and further reduce the possibility for the feeding error.

Along with the number-of-packs indicating sections 101, 102, or in place of the number-of-packs indicating sections 101, 102, serial numbers corresponding to the order of feeding the tablets may be indicated adjacently to the respective tablet housing chambers 21 on the upper surface of the tablet housing section 22.

With reference to FIG. 1 and FIGS. 8A to 8C, two sensors 27, 28 for detecting the opening/closing of the closing cover 25 are provided. The respective sensors 27, 28 are arranged at the base end of the closing cover 25. The sensors 27, 28 include magnetic bodies 27*a*, 28*a* that rotate around the pin mechanisms 100A, 100B along with the closing cover 25 and fixed sensor bodies 27*b*, 28*b* for detecting magnetism of the magnetic bodies 27*a*, 28*a* which are hall elements and the like. The magnetic bodies 27*a*, 28*a* of the two sensors 27, 28 are arranged in pin axes of the pin mechanisms 10A, 100B so as to have angle positions different from each other. The sensor bodies 27*b*, 28*b* of the two sensors 27, 28 are opposed to the corresponding magnetic bodies 27*a*, 28*b*, and arranged with the identical angle positions with respect to the pin axes of the pin mechanisms 100A, 100B. As described later in detail, providing the two sensors 27, 28 enables accurate detection of whether the closing cover 25 has been set at either the closed position or the open position and also enables prevention of erroneous determination of whether the closing cover 25 has been set at either the closed position or the open position even if failure of at least one of the sensors 27, 28 is occurred.

When the closing cover 25 is at the closed position as shown in FIG. 8C, the sensor 27 becomes an ON state where the magnetic body 27*a* and the sensor body 27*b* are at the closest positions to each other. When the closing cover 25 is at the open position as shown in FIG. 8B, the sensor 27 becomes an OFF state where the magnetic body 27*a* and the sensor body 27*b* are separated. Contrarily to this, when the closing cover 25 is at the open position as shown in FIG. 8B, the sensor becomes the ON state where the magnetic body 28*a* and the sensor body 28*b* are at the closest positions to each other. When the closing cover 25 is at the closed position as shown in FIG. 8C, the sensor becomes the OFF state where the magnetic body 28*a* and the sensor body 28*b* are separated. The configurations of the sensors 27, 28 are not limited to this example and any configurations may be employed so long as one sensor comes into the ON state when the closing cover 25 is at the closed position and comes into the OFF state when the closing cover 25 is at the open position, and the other sensor comes into the OFF state when the closing cover is at the closed position and comes into the ON state when the closing cover is at the open position.

Figure 8A:
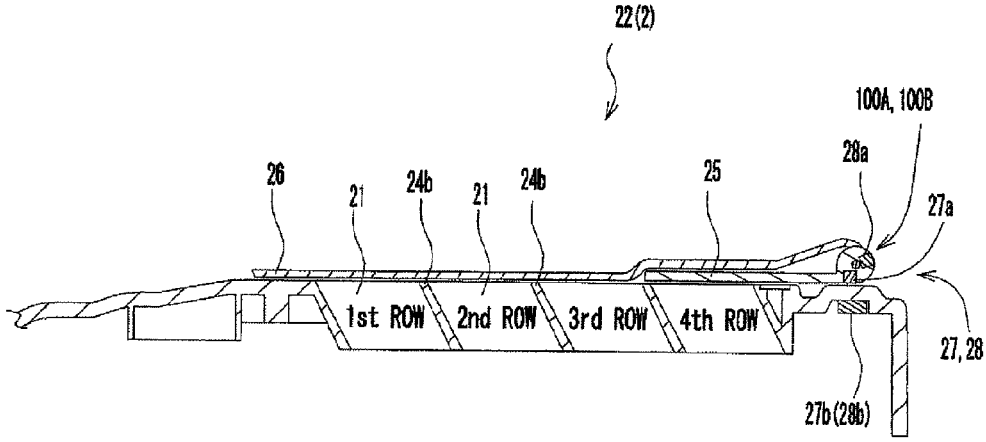
FIG. 8A is a partial sectional view of the tablet supply unit with the closing cover and a protection cover in the closed state.
Figure 8B:
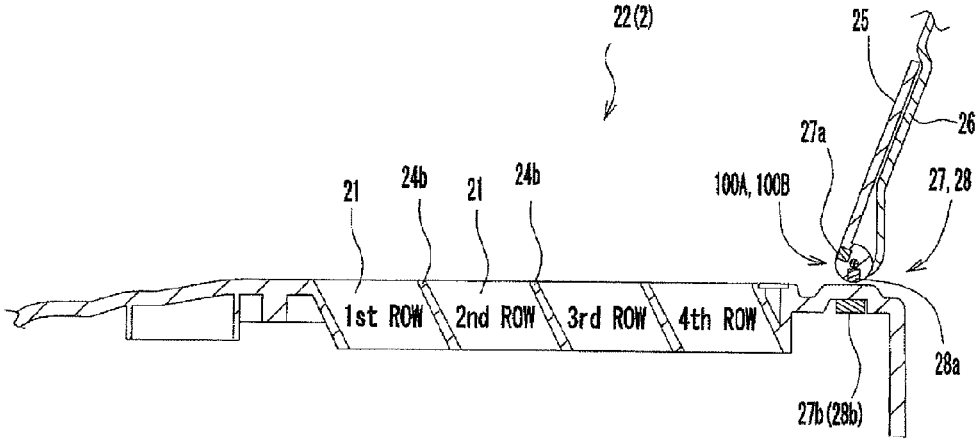
FIG. 8B is a partial sectional view of the tablet supply unit with the closing cover in the open state.
Figure 8C:
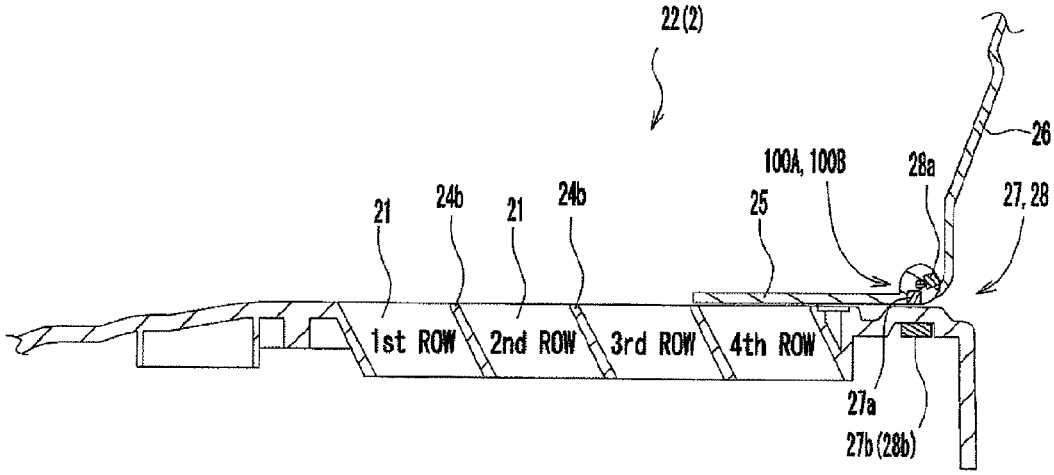
FIG. 8C is a partial sectional view of the tablet supply unit with the closing cover in the closed state.
Figure 8D:
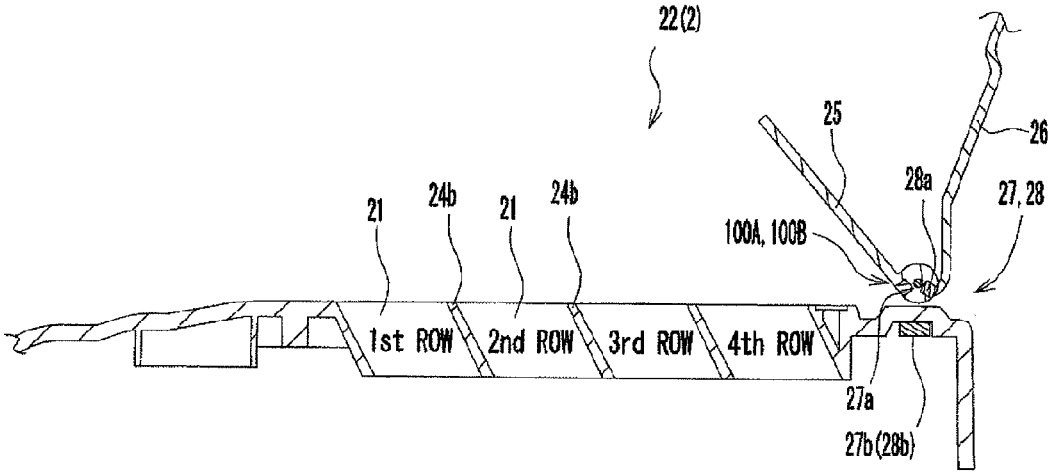
FIG. 8D is a partial sectional view of the tablet supply unit with the closing cover in a partly open state.
Figure 9A:
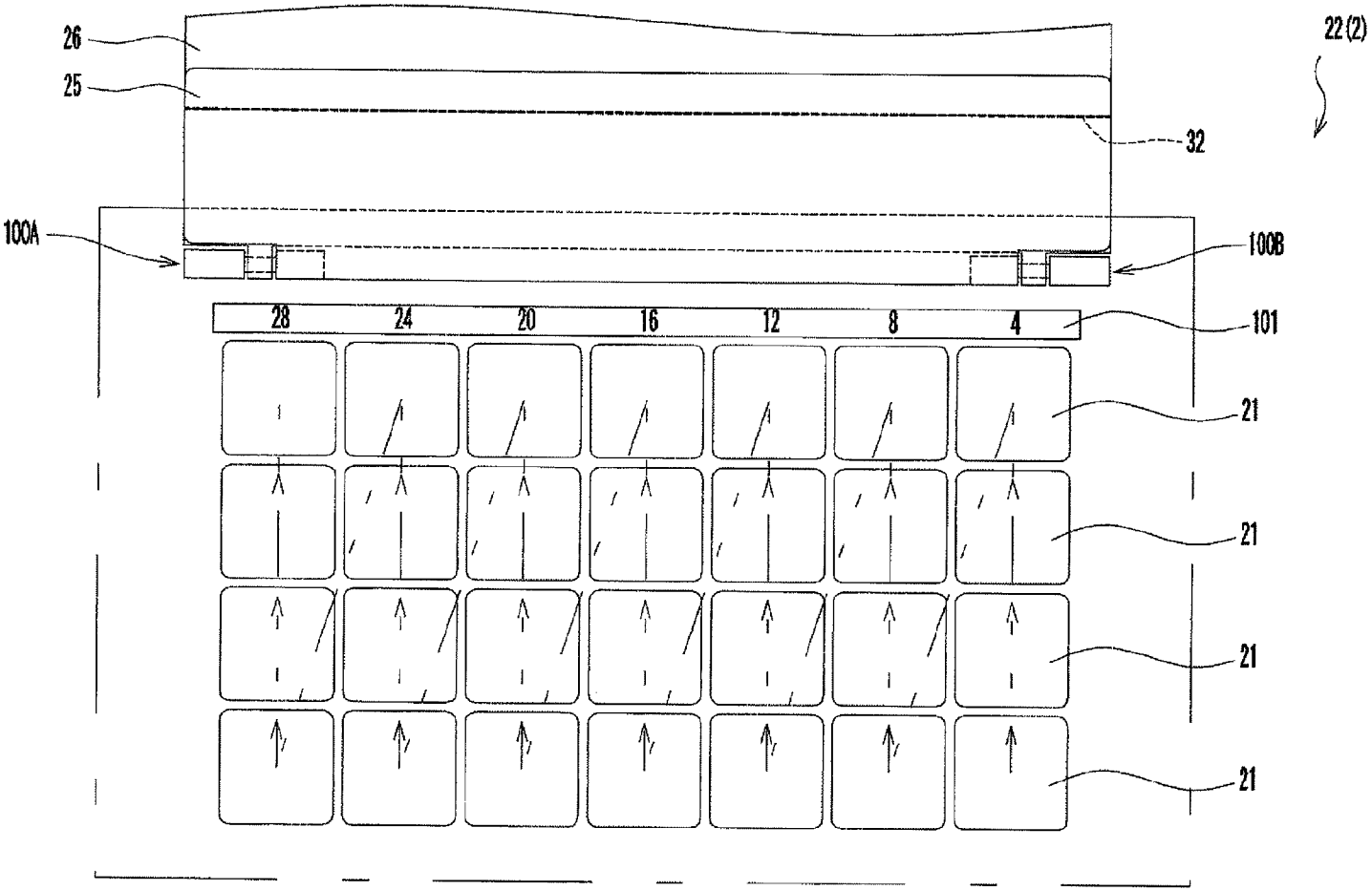
FIG. 9A is a plan view of the tablet supply unit with the closing cover in the open state.
Figure 9B:
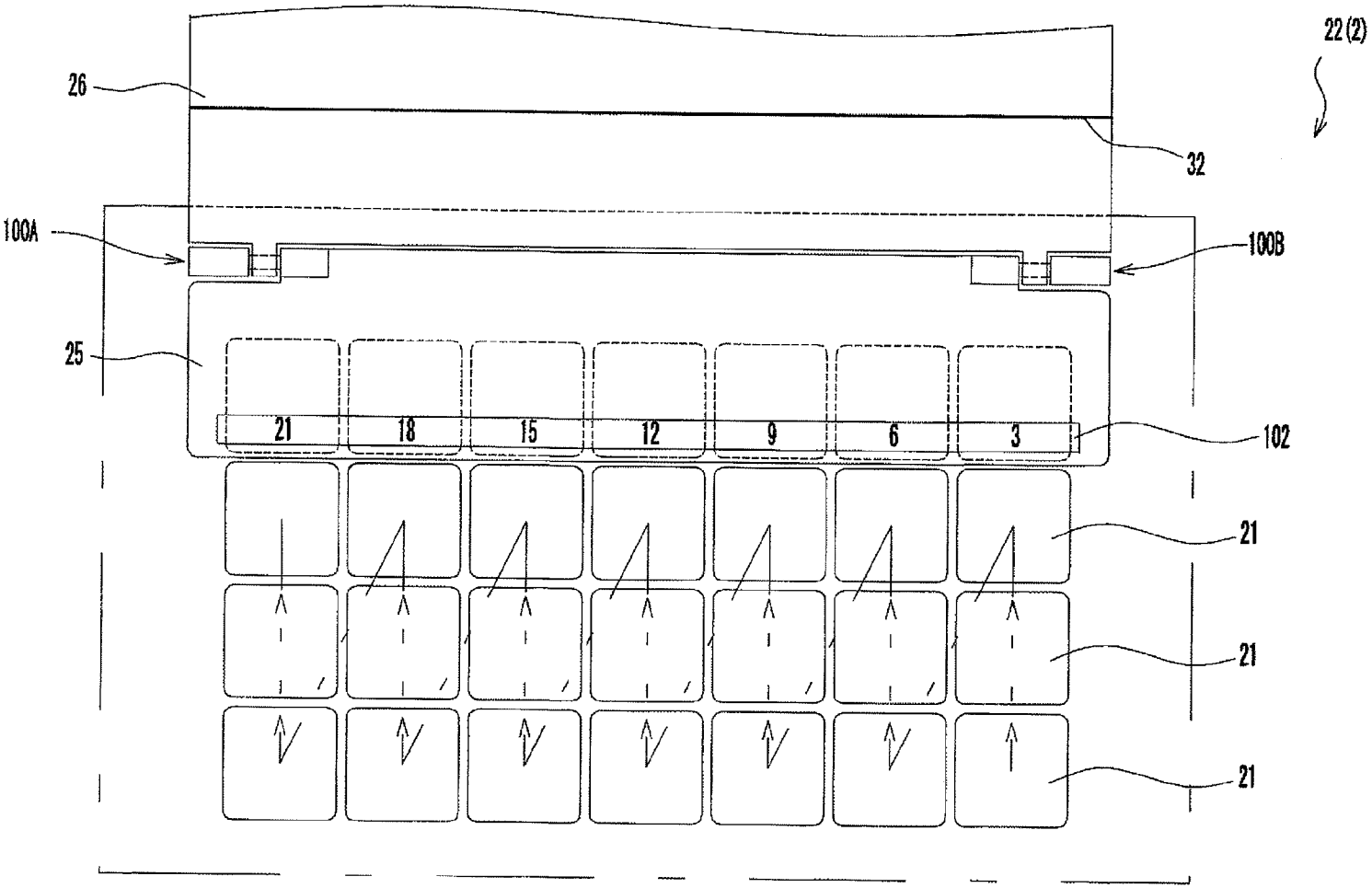
FIG. 9B is a plan view of the tablet supply unit with the closing cover in the closed state.
Figure 10:
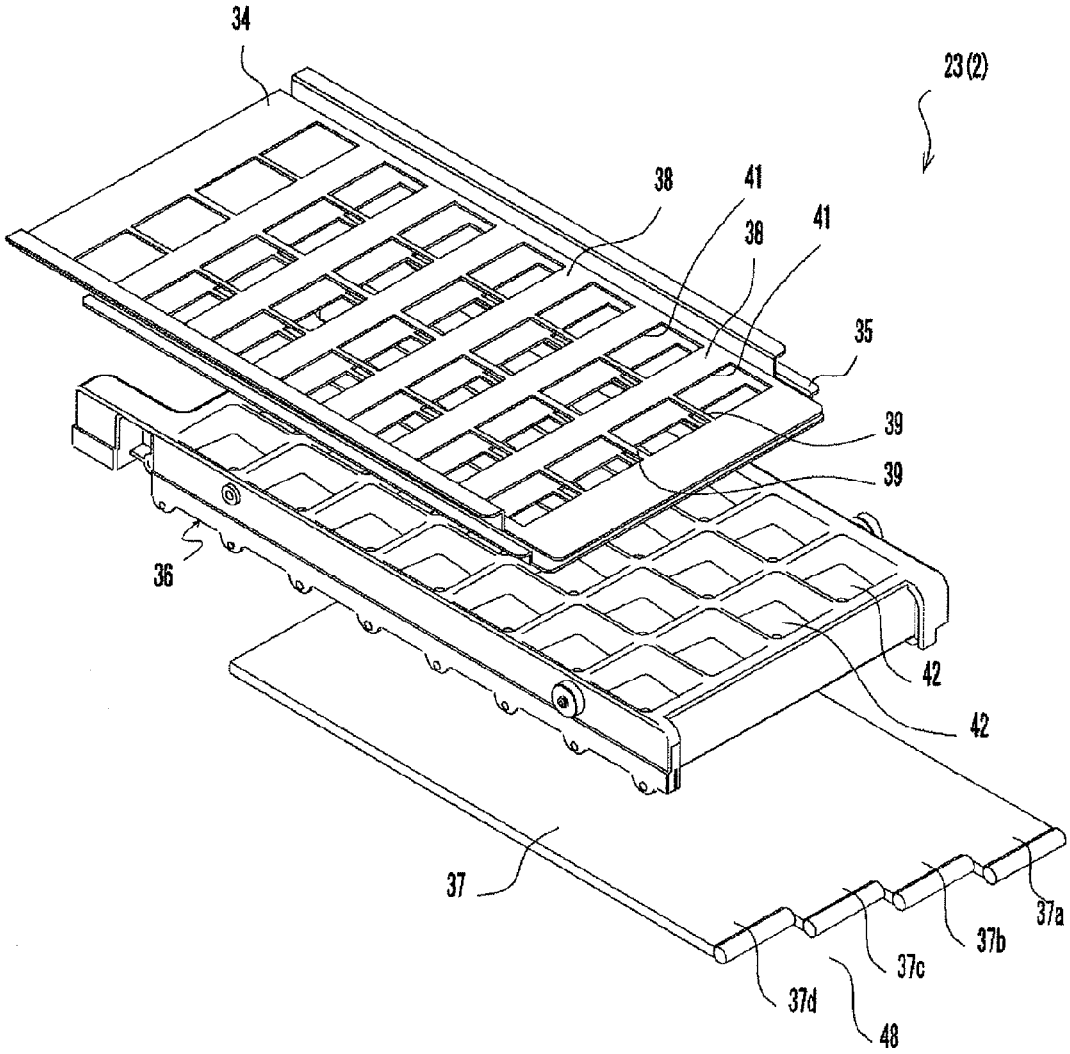
FIG. 10 is an exploded perspective view of a medicine discharge section.

With reference to FIGS. 8A and 8C, the protection cover 26 is settable at the open position (FIGS. 8B and 8C) and at the closed position (FIG. 8A) by being rotated around the pin mechanism 100A, 100B when the closing cover 25 is at the closed position. When the protection cover 26 is at the closed position, the upper end openings 21*a* of all of the tablet housing chambers 21 are covered by the protection cover 26. Therefore, when the tablet supply unit 2 is not used, the protection cover 26 is set at the closed position so as to reliably prevent approach of dust and the like to the tablet housing chambers 21.

With reference to FIGS. 1, 2, 9A and 9B, an inner surface of the protection cover 26 is provided with a display 32 for indicating the use of the tablet housing chamber 21 of all four rows. The display 32 is positioned so as to be hidden behind the closing cover 25 at the open position (FIG. 9A) and to be visible when the closing cover 25 is at the closed position (FIG. 9B). This facilitates that the operator visually checks whether the tablet housing chambers 21 of the tablet supply unit 2 are in a state corresponding to the "three times daily dosage" or in a state corresponding to the "two times daily dosage" or "four times daily dosage".

With reference to FIGS. 5A to 5C and FIG. 10, the tablet discharging section 23 of the tablet supply unit 2 includes an upper shutter plate 34 arranged under the tablet housing section 22, a lower shutter plate 35 arranged in a state of being mutually superimposed under the upper shutter plate 34, a movable discharging member 36 arranged under the lower shutter plate 35, and a fixing plate 37 arranged under the discharging member 36.

Figure 5A:
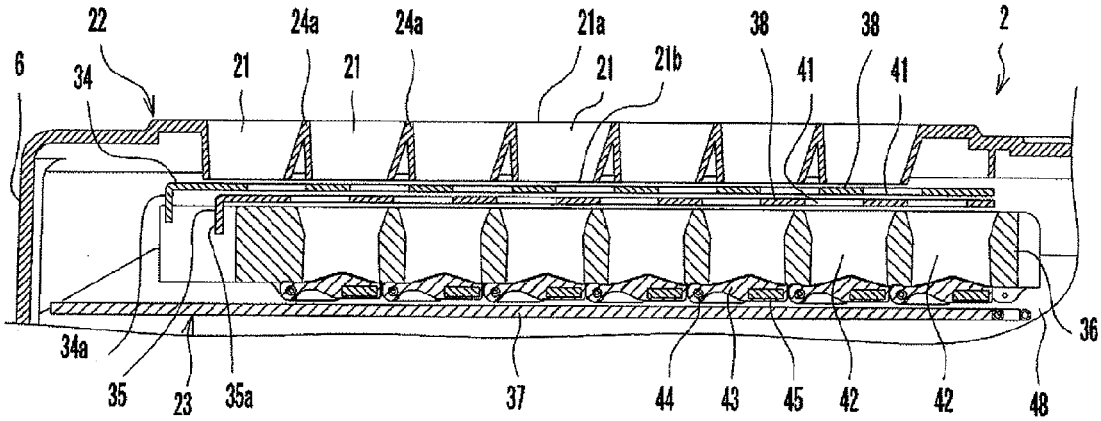
FIG. 5A is a partial sectional view of a tablet supply unit with a shutter in a closed state.
Figure 5B:
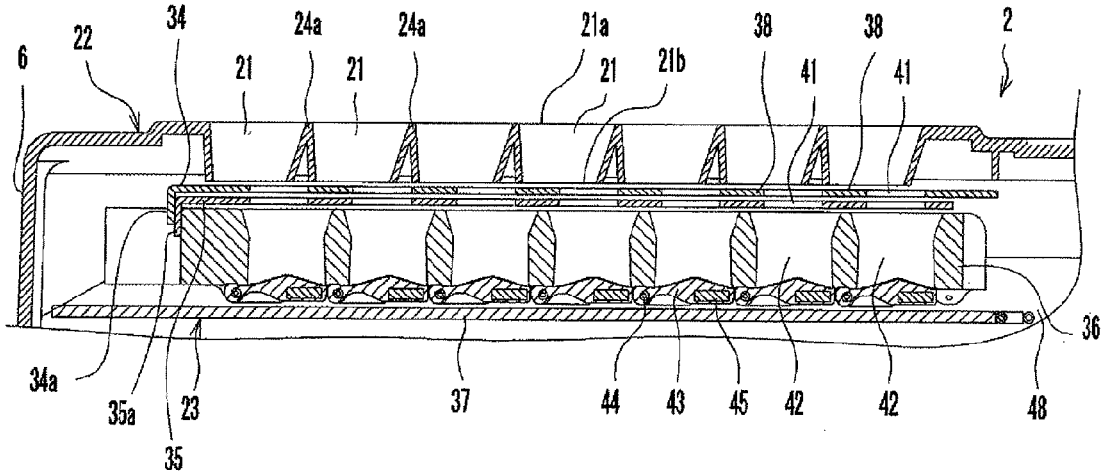
FIG. 5B is a partial sectional view of the tablet supply unit with the shutter being opened.
Figure 5C:
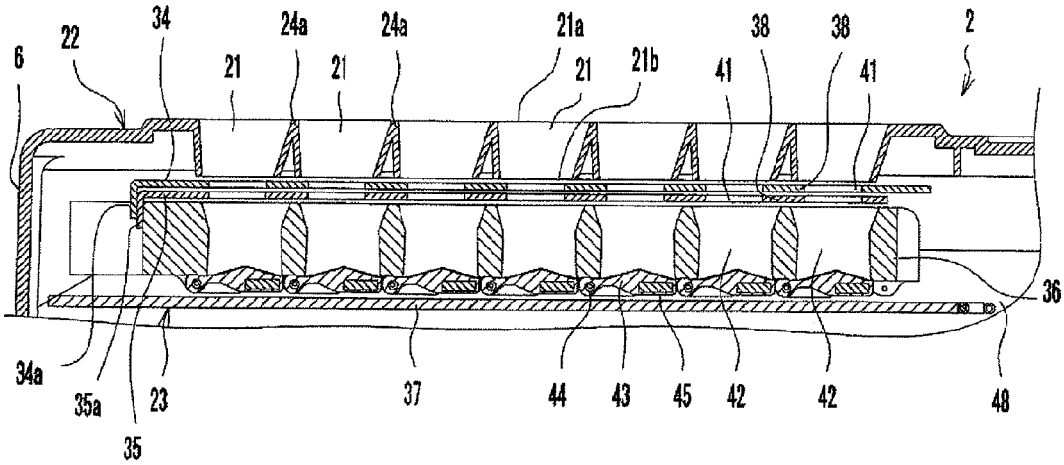
FIG. 5C is a partial sectional view of the tablet supply unit with the shutter in an open state.

The upper and lower shutter plates 34, 35 are movable in the column direction of the arrangement of the tablet housing chambers 21, while holding the mutually superimposed state. In each of the upper and lower shutter plates 34, 35, a total of 28 tablet passage holes 41 are formed in four rows and seven rows. The tablet passage holes 41 are defined by first partition sections 38 extending in the row direction of the arrangement of the tablet housing chambers 21 and second partition sections 39 extending in the column direction of the arrangement of the tablet housing chambers 21 and respectively correspond to the tablet housing chambers 21. Further, the left-side ends of the upper and lower shutter plates 34, 35 in FIGS. 5A to 5C are provided with downwardly folded engaging sections 34*a*, 35*a*. Moreover, the upper shutter plate 34 is connected to the tablet housing section 22 by a spring (not shown) so as to be elastically biased rightward in FIGS. 5A to 5C. Furthermore, the lower shutter plate 35 is connected to the upper shutter plate 34 by a spring (not shown) so as to be elastically biased rightward in FIGS. 5A to 5C. In an initial state where external force does not act upon the upper and lower shutter plates 34, 35, the upper and lower shutter plates 34, 35 are at positions shown in FIG. 5A.

The discharging member 36 is reciprocatingly movable in the column direction of the arrangement of the tablet housing chambers 21 by a driving device including a pinion-rack mechanism and a motor. The discharging member 36 is provided with a total of 28 tablet discharging chambers 42 in four rows and seven columns corresponding to the tablet housing chambers 21 of the tablet housing section 22. Both of the upper and lower ends of the tablet discharging chambers 42 are open. Openable and closable bottom plates 43 are arranged at the openings on the lower end side of the respective tablet discharging chambers 42. One end of the bottom plate 43 is rotatably supported by a pin 44 with respect to the discharging member 36 and has a weight 45 for opening embedded in the other end side.

The bottom plates 43 of the tablet discharging chambers 42 are placed on the upper surface of the fixing plate 37 and thereby the bottom plates 43 are held at a closed position. Further, the right-side end of the fixing plate 37 in FIGS. 5A to 5C and FIG. 10 is provided with stages 37*a* to 37*d* in identical number to the number of rows of the tablet housing chambers 21 and the tablet discharging chambers 42 (four rows in this embodiment). A gap between the adjacent two of the stages 37*a* to 37*d* corresponds to a value obtained by dividing formation pitches in the column direction of the tablet housing chambers 21 and the tablet discharging chambers 42 by the number of rows of the tablet housing chambers 21 and the tablet discharging chambers 42.

Figure 11:
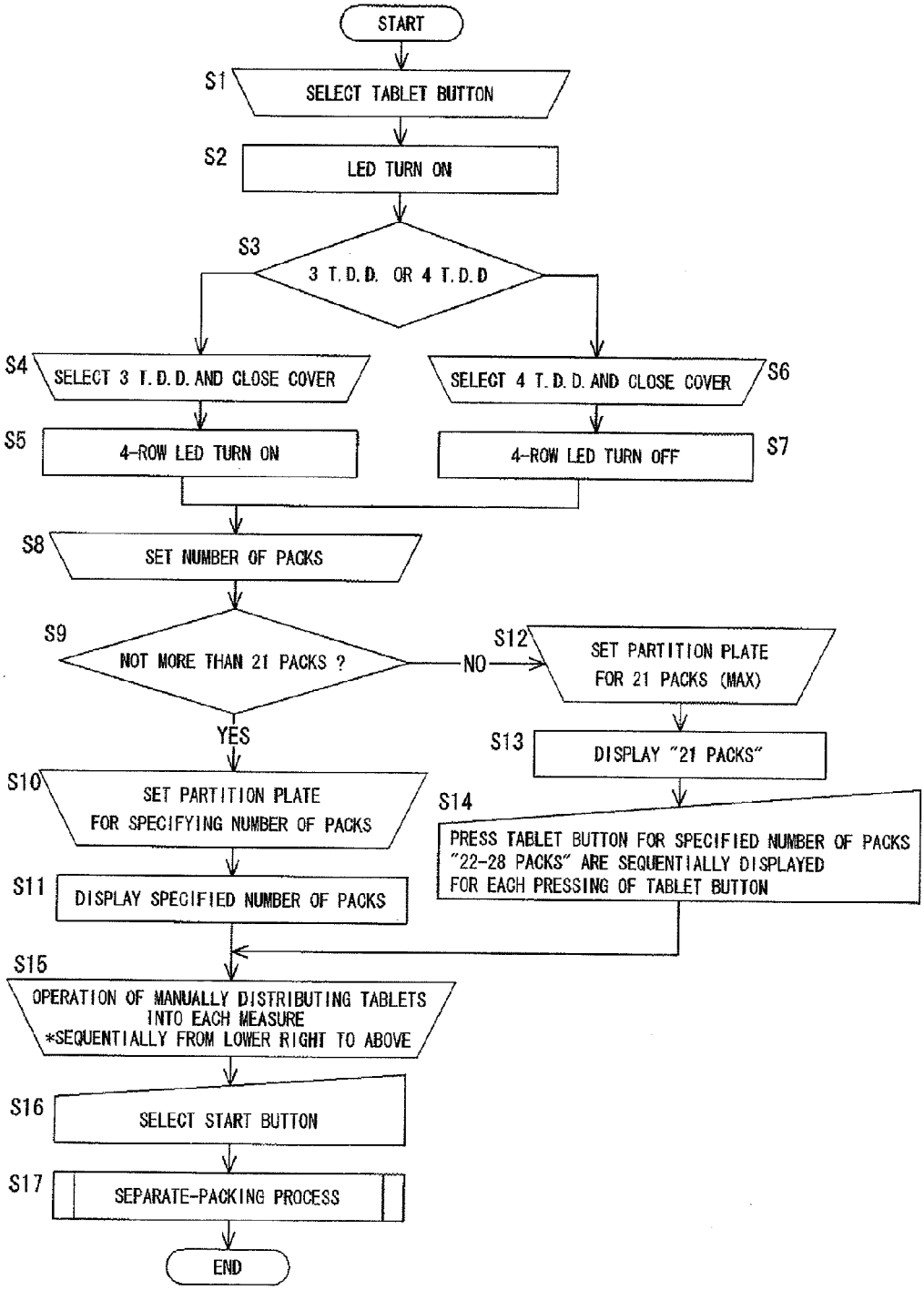
FIG. 11 is a flowchart for describing an operation of the tablet supply unit.

Next, with reference to a flowchart of FIG. 11, the operation of the tablet supply unit 2 is described. First, in step S1, a tablet button 9*a* on the control panel 9 (hereinafter, refer to FIG. 3 in regard to buttons, LEDs, and the like) is selected, and in step S2, an LED corresponding to the tablet button 9*a* is turned on. Next, in step S3, either "three times daily dosage" or "four times daily dosage" is selected. Specifically, in a case of selecting the "three times daily dosage", in step S4, the closing cover 25 is manually set at the closed position (FIGS. 8C and 9B), and in step S5, an LED 9*b* indicating the use of the tablet housing chambers 21 of four rows is turned off. Further, in a case of selecting the "four times daily dosage", in step S6, the closing cover 25 is manually set at the open position (FIGS. 8B and 9A), and in step S6, the LED 9*b* is turned on.

Subsequently, in step S8, the number of packs is set, and in step S9, when the number of packs to be set is not larger than 21, partitioning plates 52 of a later-mentioned V-chamber 51 is moved to a position corresponding to the number of packs to be set. The positions of the partitioning plates 52 are detected by the sensor and outputted to the controller 11 of the tablet supply unit 2. The specified number of packs is indicated in a number-of-packs indicating section 9*c* of the control panel 9 in step S21. Meanwhile, in step S9, when the number of packs to be set is not smaller than 21, the number of packs in the partitioning plates 52 of the V-chamber 51 is set to 21 as the maximum value, and in step S13, "21" is indicated as the number of packs in the number-of-packs indicating section 9*c* of the control panel 9. In step S14, every time the tablet button 9*a* of the control panel 9 is pressed, the number of packs from "22" to "28" as the maximum number of packs of the tablet supply unit 2 is sequentially indicated as the number of packs at the number-of-packs indicating section 9*c*.

Next, in step S15, the tablets are fed from the upper end openings 21*a* by the manual distribution operation and the tablets are housed in the respective tablet housing chambers 21. At this time, the tablets are fed sequentially in the row direction from the tablet housing chamber 21 in the right-most-side column and the front-side (nearest-side) row toward the rear side (back side).

Upon completion of the manual distribution operation, when a start button 9*d* of the control panel 9 is selected in step S16, in step S17, the tablet discharging section 23 is operated to send the tablets supplied from the tablet housing section 22 to a hopper 67 of the packaging unit 4 through a carrier channel (not shown) one-by-one dose and separate packing processing is executed in the packaging unit 4.

In step S16, when detecting that the closing cover 25 is in an unstable state at the time of selection of the start button 9*d*, the controller 11 outputs an error sound and also inhibits the tablet discharging section 23 from starting its operation to stop supply of the tablet to the packaging unit 4. Specifically, when the one sensor 27 is in the ON state and the other sensor 28 is in the OFF state, the controller 11 determines that the closing cover 25 has been accurately set at the closed position (FIG. 8C), and operates the tablet discharging section 23. Further, when the one sensor 27 is in the OFF state and the other sensor 28 is in the ON state, the controller 11 determines that the closing cover 25 has been accurately set at the open position (FIG. 8B), and operates the tablet discharging section 23. However, when both of the two sensors 27, 28 are in the ON state or in the OFF state, the controller 11 determines that the closing cover 25 is in the unstable state of being neither at the closed position nor the open position (FIG. 8D) or that a failure has occurred in at least one of the sensors 27, 28, and thus inhibits the tablet discharging section 23 from starting its operation. When the closing cover 25 is in an unstable form, the tablet discharging section 23 is inhibited from starting its operation so as to reliably prevent the tablets housed in the respective tablet housing chambers 21 in inadequate manner from being erroneously packaged in the packaging unit 4.

In the following, the operation of the tablet discharging section 23 in the pack distribution processing in step S17 is described in detail. First, before selection of the start button 9*d*, namely during non-activation, the tablet discharging section 23 is in a state shown in FIG. 5A. Specifically, the upper and lower shutter plates 34, 35 are in a retaining position where lower end openings 21*b* of the respective tablet housing chambers 21 are closed by the first partition sections 38 of the upper shutter plate 34 and the first partition sections 38 of the lower shutter plate 35.

When the start button 9*d* is selected, the discharging member 36 moves in the left direction (row direction) in the figure as shown in FIG. 5B on the condition that the closing cover 25 has been accurately set at the closed position or the open position, that the closing cover 25 has not been set in the unstable state, and that no failure has occurred in the sensors 27, 28. One end of the discharging member 36 is hooked onto an engaging section 35*a* of the lower shutter plate 35, resulting in that the lower shutter plate 35 also moves in the left direction along with the discharging member 36. Further movement of the discharging member 36 in the left direction in the figure causes the one end of the discharging member 36 to be hooked onto an section 34*a* of the upper shutter plate 34 through the engaging section 35*a* of the lower shutter plate 35, resulting in the upper shutter plate 34 also moving in the left direction along with the discharging member 36.

With the move of the upper and lower shutter plates 34, 35 along with the discharging member 36, the tablet discharging section 23 becomes a state shown in FIG. 5C. Specifically, as for the upper and lower shutter plates 34, 35, the first partition sections 38 of the upper shutter plate 34 are receded to the lower side of the first partition walls 24*a* of the tablet housing section 22 and the first partition sections 38 of the lower shutter plate 35 are receded to the lower side of the first partition sections 38 of the upper shutter plate 34, resulting in that the tablet passage holes 41, 42 in the upper and lower shutter plates 34, 35 come to the open position where the holes are respectively opposed to the lower end openings 21*b* of the tablet housing chamber 21. Further, when the upper and lower shutter plates 34, 35 are at the open position, the openings on the upper end side of the tablet discharging chambers 42 of the discharging member 36 become a state of being respectively opposed to the respective lower end openings 21*b*. Therefore, the tablets for each one dose which are housed in the tablet housing chambers 21 are housed into the tablet discharging chambers 42 of the discharging member 36 passing through the tablet passage holes 41, 41.

Next, the discharging member 36 moves in the right direction in the figure, resulting in that the bottom plates 43 of the tablet discharging chambers 42 sequentially reach the dropping port 48 located ahead of the stages 37*a* to 37*d* starting from the tablet discharging chamber 42 on the front side in the moving direction so that support for the bottom plates 43 is eliminated and the bottom plates 43 are opened. As a result, the tablets inside the respective tablet discharging chambers 42 are sequentially supplied into the hopper 67. In the case of the "four times daily dosage", the discharging member 36 constantly moves intermittently in the right direction in an amount corresponding to the steps. However in the case of the "three times daily dosage", since no tablet is housed inside the tablet discharging chambers 42 corresponding to the uppermost-side row, the moving amount of the discharging member 36 is set to twice as large as the step in the next intermittent movement after each of the third, sixth, ninth, twelfth, fifteenth, . . . tablet discharging chambers 42 has reached the dropping port 48.

Since the lower end openings 21*b* are closed by the first partition sections 38 of the two shutter plates, namely the upper and lower shutter plates 34, 35, the widths of the first partition sections 38 of the respective upper and lower shutter plates 34, 35 can be set narrow. Thereby, the width of the first partition wall 24*a* of the tablet housing section 22, to which the first partition section 38 is receded at the open position, can be set narrow, resulting in reduction in the size of the tablet supply unit 2. By the reduction in the size of the tablet supply unit 2, reduction in size of the medicine packaging apparatus 1 as a whole can be achieved.

(Powdered Medicine Supply Unit)

The powdered medicine supply unit 3 is manually supplied with powdered medicines, automatically divides the powdered medicines for each dosage, and sequentially supplies the divided medicines to the packaging unit 4.

With reference to FIGS. 1 and 2, the powdered medicine supply unit 3 includes a long chamber that is open to the upper surface of the medicine discharge section 5 and has a roughly V-shaped cross section (V-chamber 51). The bottom section of the V-chamber 51 is openable and closable. Further, a plurality of dividing containers (not shown) is arranged below the V-chamber 51. When the bottom sections are opened, powdered medicines has been fed into the V-chambers 51 drop into the dividing containers to be divided into a predetermined amount. The bottom sections of the dividing containers are also openable and closable. By sequentially opening the bottom sections of the dividing containers, the powdered medicines inside the respective dividing containers drop into the hopper 67, and are supplied to the packaging unit 4 one-by-one dose. Further, a movable partitioning plate 52 for adjusting the number of powdered medicines to be divided are arranged.

The configuration of the powdered medicine supply unit 3 is not particularly limited so long as powdered medicines can be supplied to the packaging unit 4 one-by-one dose. For example, the powdered medicine supply unit 3 may have a distribution plate with an outer peripheral circular groove to which the powdered medicines are fed from a hopper. A scraping out apparatus sequentially scrapes out the powdered medicines one-by-one dose from outer peripheral circular groove to supply them to the packaging unit 4.

(Packaging Unit)

In the following, the packaging unit 4 is described with reference to FIGS. 12 to 23. The packaging unit 4 includes, on a holding frame 71, a sheet supply section 63, an unfolding guide 65, the hopper 67, a heat sealing section 68, and a printing section 69. The sheet supply section 63 is provided with a roll 62 to which a long slender package sheet 61 previously folded into two along a longitudinal direction is wound and winds off the package sheet 61 for supply. The unfolding guide 65 expands or unfolds the package sheet 61 supplied by the sheet supply section 63 to open the package sheet 61. The hopper 67 is supplied with the medicines from the tablet supply unit 2 and the powdered medicine supply unit 3. The medicines are introduced from an opening of the package sheet 61 through a feed port 67*a* of the hopper 67. The heat sealing section 68 seals the package sheet 61 so as to enclose the introduced medicines. The printing section 69 is arranged between the sheet supply section 63 and the unfolding guide 65 in a route of the package sheet 61 and prints such information, as a name of a patient, a name of the medicine, and a usage of the medicine on the package sheet 61.

Figure 14:
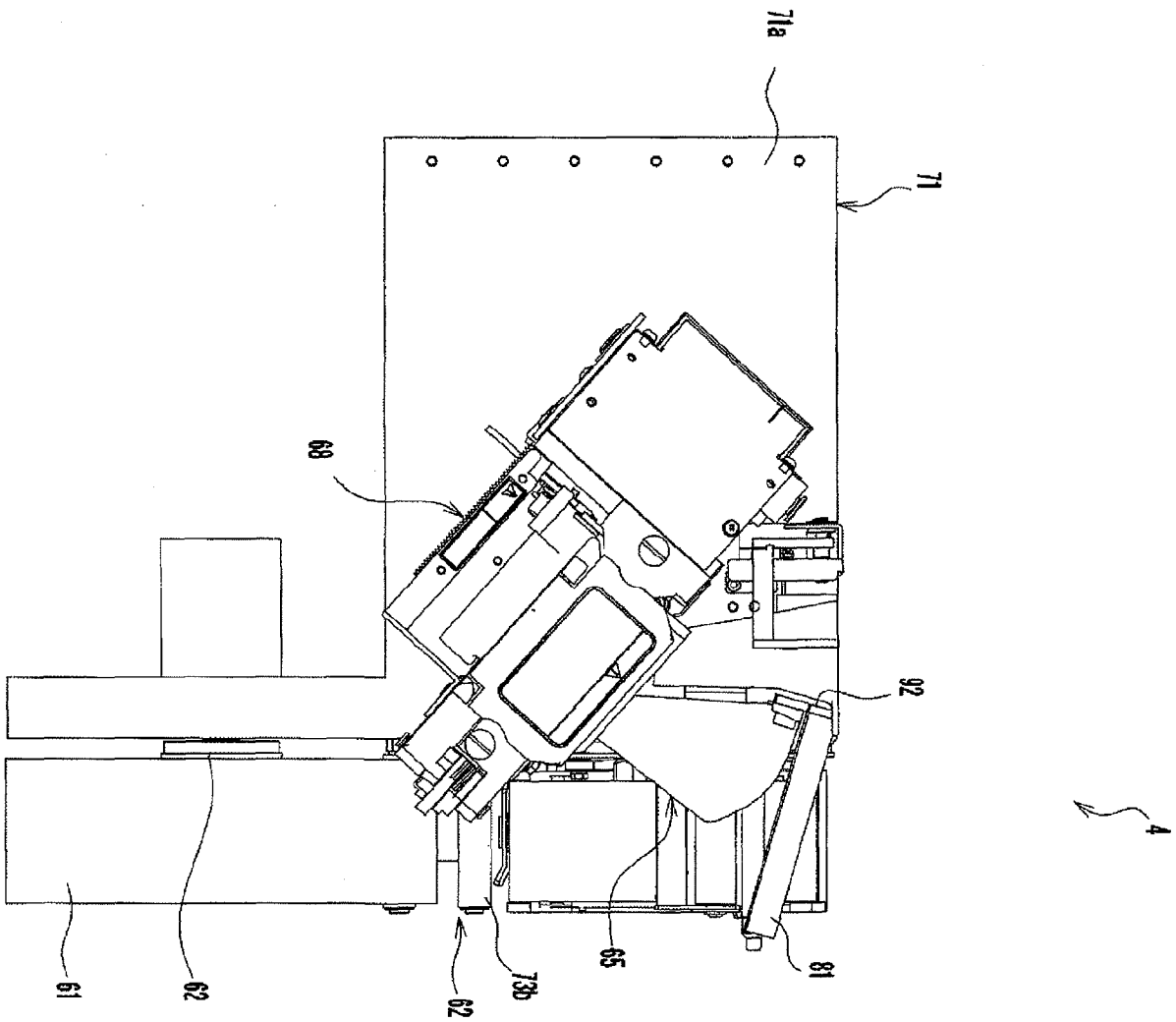
FIG. 14 is a front view of the packaging unit.

With reference to FIGS. 12 to 16, the packaging unit 4 is provided in a holding frame 71 arranged in the housing space 7 of the housing 6. The holding frame 71 includes a front holding section 71*a* extending on a front side of the housing 6, a side holding section 71*b* extending from a right side to a rear side seen from the front side of the front holding section 71*a*, and a hinge mechanism 72 rotatably connecting the side-end side on the left side seen from the front side of the front holding section 71*a* to the housing 6 (further refer to FIGS. 17 and 18). Such a configuration achieves favorable operability as described later in detail, while allowing a compact housing of the packaging unit 4 inside the housing 6. A base plate (not shown) is provided at a position immediately above the top of the holding frame 71 (refer to. FIG. 14), and the tablet supply unit 2 and the powdered medicine supply unit 3 are arranged on this base plate. As seen from the above, providing the packaging unit 4 on the holding frame 71 enables compact housing of the packaging unit 4 inside the housing 6 having a limited vertical space.

The roll 62 for the package sheet 61 is arranged in a lower region of the side holding section 71*b* of the holding frame 71. Further, the side holding section 71*b* of the holding frame 71 is provided with two guide rollers 73*a*, 73*b* that constitute part of the sheet supply section 63. A rotational center of the roll 62 and the guide rollers 73*a*, 73*b* extends in a direction substantially orthogonal to the side holding section 71*b* (direction in which the front holding section 71*a* extends). Further, the printing section 69 is arranged above the guide rollers 73*a*, 73*b* of the side holding section 71*b* of the holding frame 71. The package sheet 61 is wound off from the roll 62 to the rear side, horizontally folded by the one guide roller 73*a* to the front side, and further diverted upward by the other guide roller 73*b* to be guided to the printing section 69.

The printing section 69 includes a replaceable ink cartridge 76 having a winding-off roller and a winding-up roller for thermal transfer ink ribbon, a biasing roller 77 that adds stress to the ink ribbon 75, a thermal transfer head 78, and a backup roller 79 for closely contacting the package sheet 61 to the ink ribbon 75 in a portion of the thermal transfer head 78.

Arranged in a region on the upper side and on the right end side of the front holding section 71*a* of the holding frame 71 seen from the front surface is a fixed guide rod 81 (constituting part of the sheet supply section 63) which guides the package sheet 61 having passed through the printing section 69 to the front side and obliquely downward seen from the front surface. This guide rod 81 extends from the front holding section 71*a* in the extending direction of the front holding section 71*a* and obliquely downward. As most clearly shown in FIG. 12, a direction in which a side edge of the guide rod 81 at the downstream side of the carrying direction of the package sheet 61 is consistent with a direction in which a later-described main edge line 94 of the unfolding guide 65 extends.

In the front holding section 71*a* of the holding frame 71, the unfolding guide 65 is arranged at obliquely lower left of the guide rod 81 seen from the front surface (downstream side of the carrying direction of the package sheet 61). The unfolding guide 65 is described later in detail. Further, the hopper 67 is held in the front holding section 71*a* of the holding frame 71 and the feed port 67*a* of the bottom of this hopper 67 is located at obliquely lower left of the unfolding guide 65 seen from the front surface. Furthermore, the heat sealing section 68 is arranged at a position obliquely below the feed port 67*a* of the hopper 67 seen from the front surface.

Figure 12:
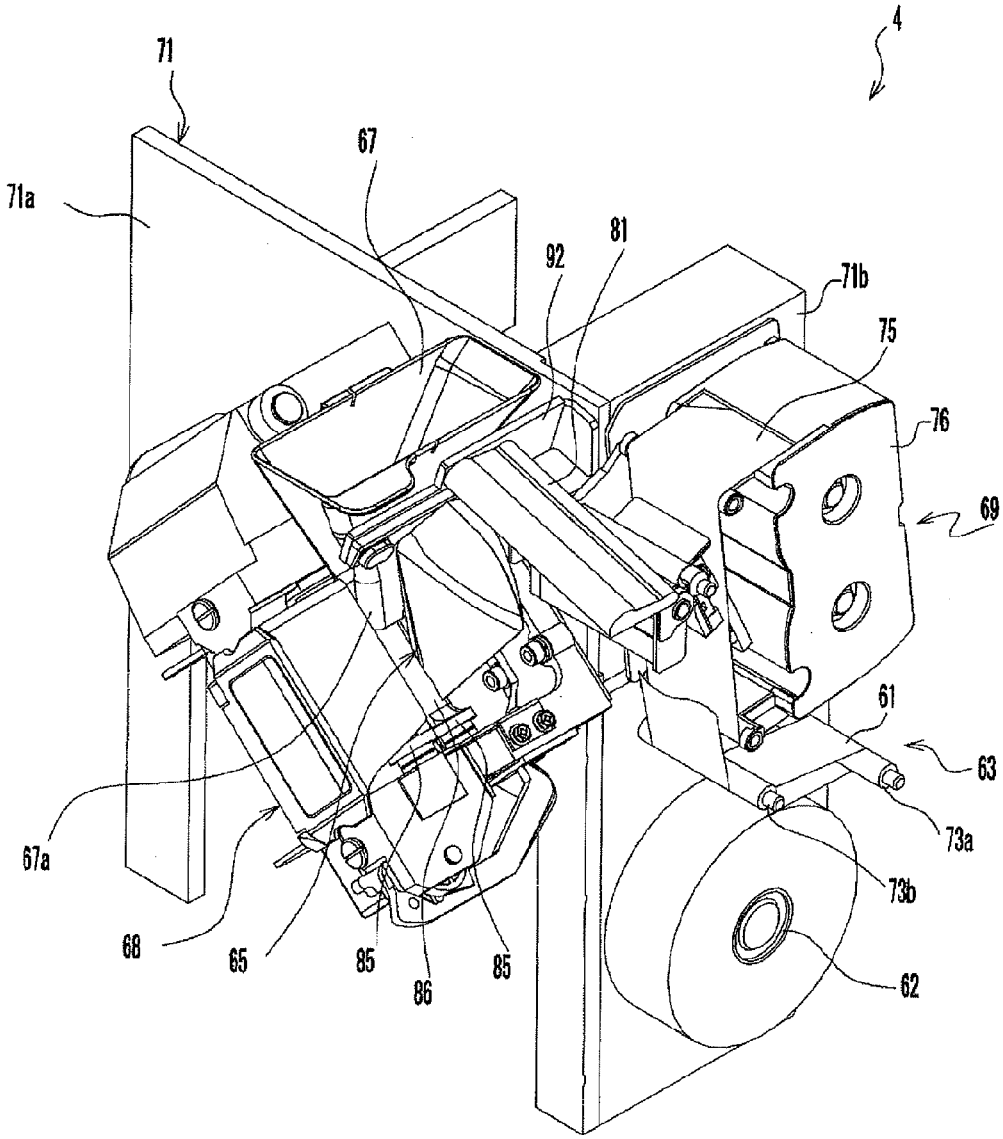
FIG. 12 is a perspective view of a packaging unit seen from side upper direction.
Figure 13:
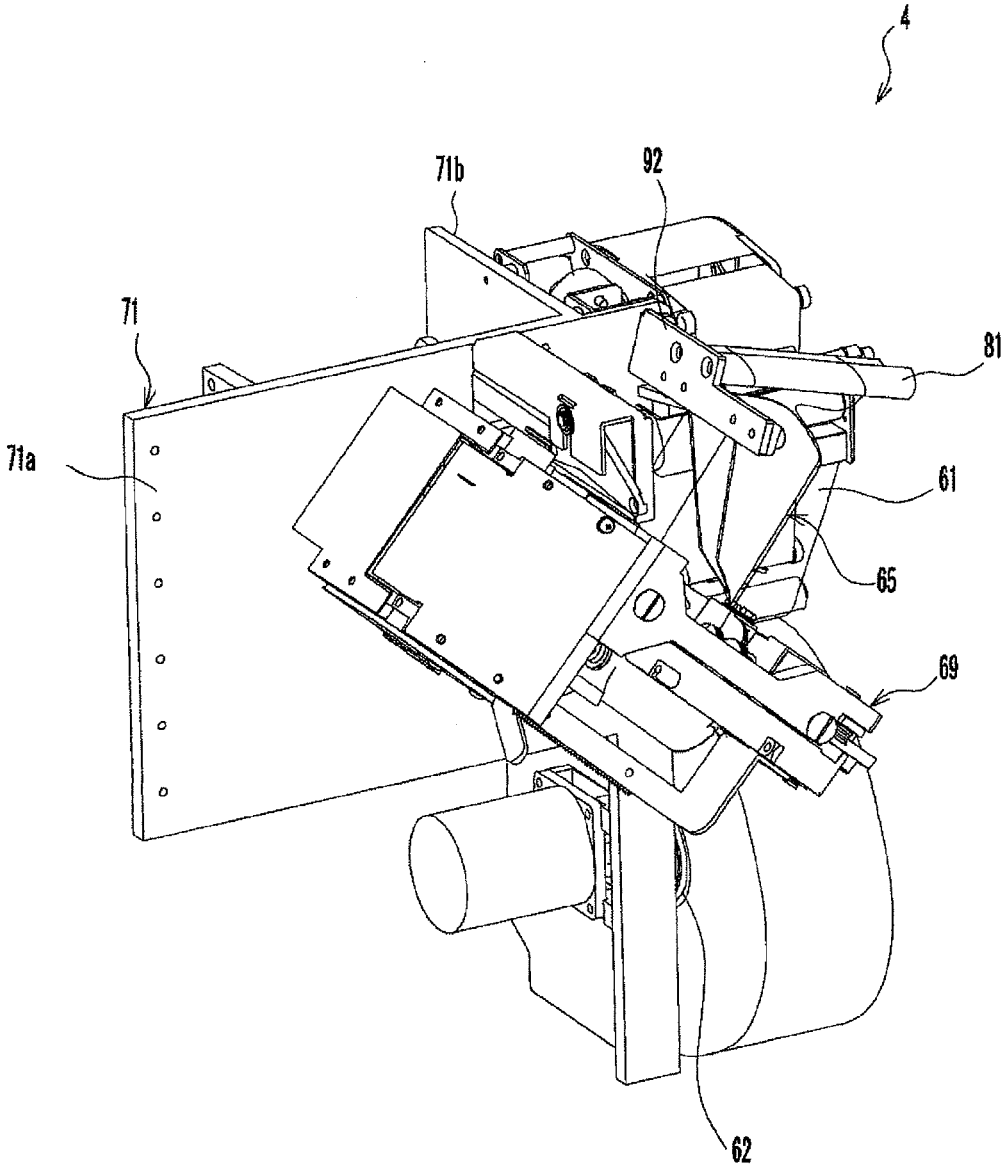
FIG. 13 is a perspective view of the packaging unit seen from front upper direction.
Figure 15:
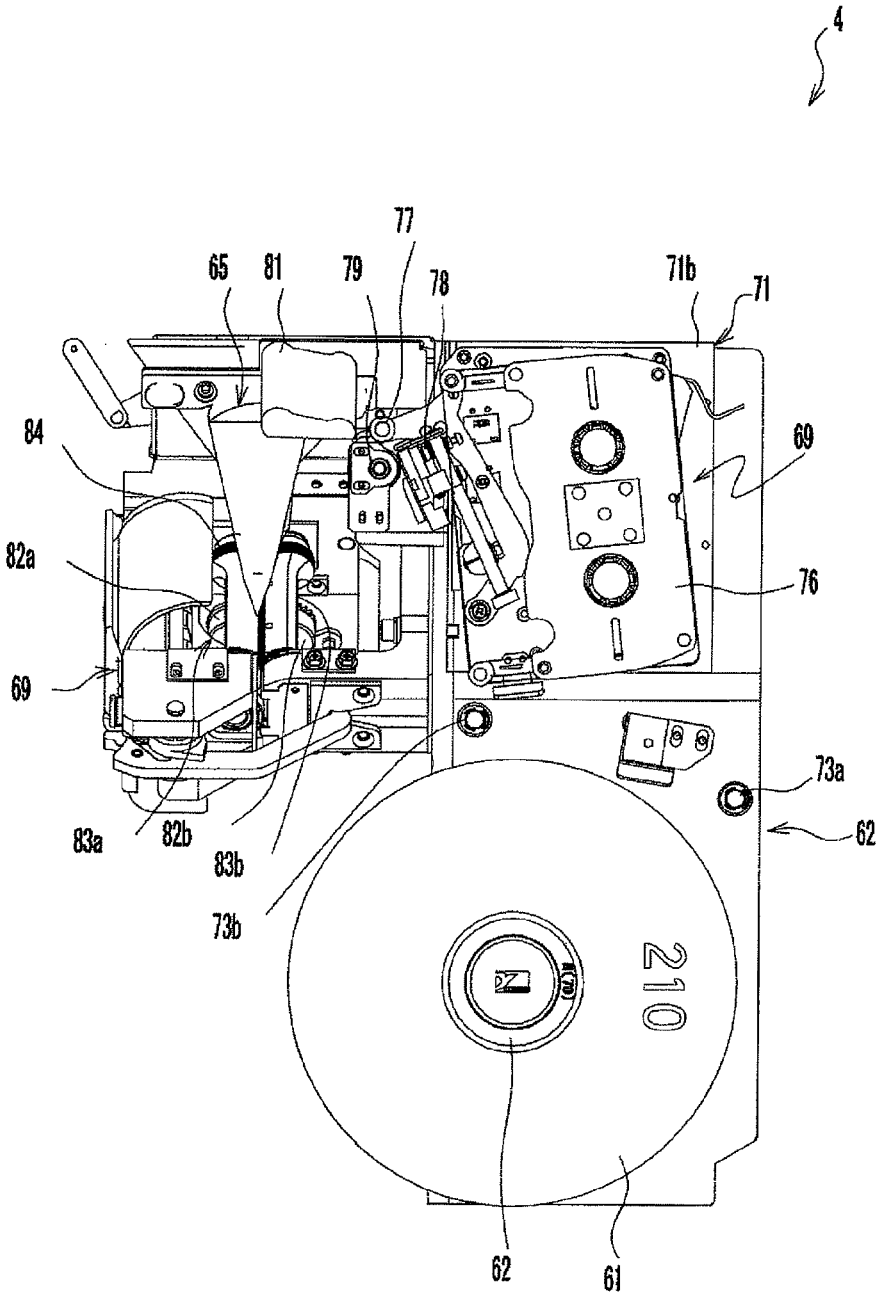
FIG. 15 is a side view of the packaging unit.
Figure 16:
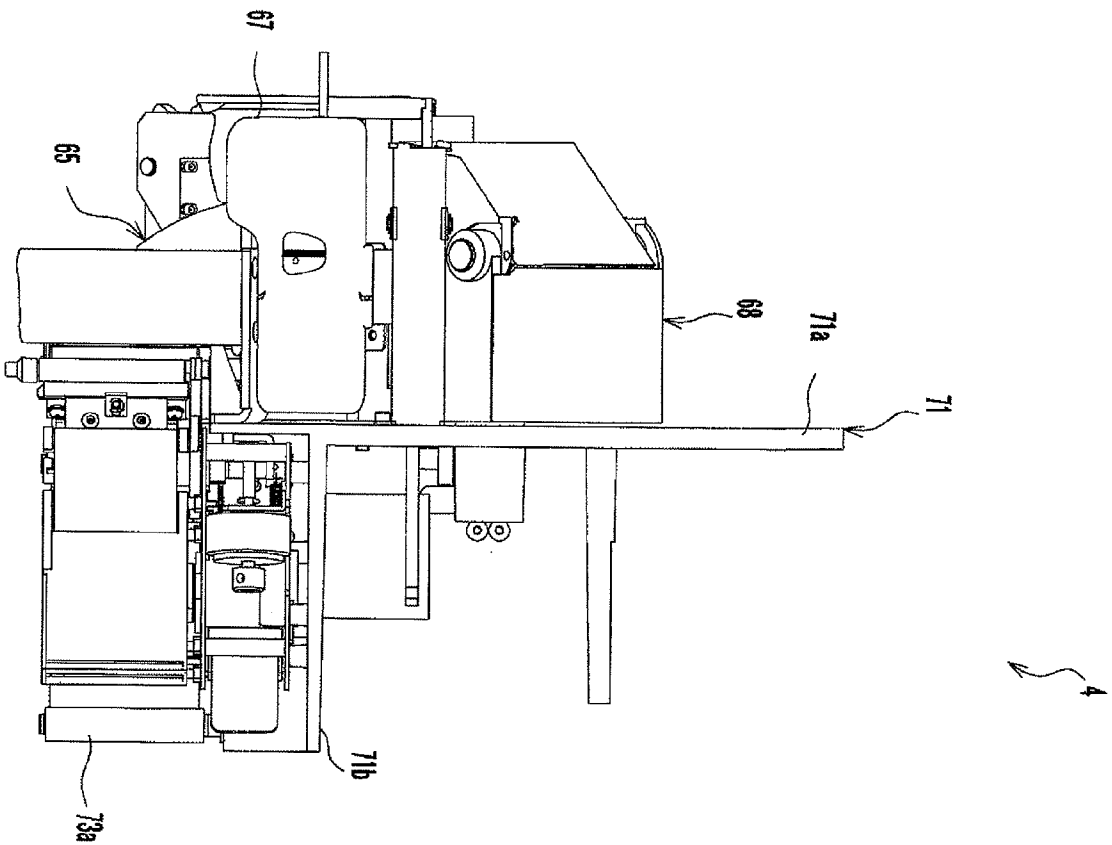
FIG. 16 is a plan view of the packaging unit.

With reference to FIGS. 12 and 15, the heat sealing section 68 includes a pair of feed rollers 82*a*, 82*b* which is intermittently rotatably driven by a driving mechanism (not shown) including a motor, a direct driven gear, an intermittent gear, and the like. The package sheet 61 is sandwiched between the feed rollers 82*a*, 82*b*, and carried by intermittent rotation of the feed rollers 82*a*, 82*b*. Further, a pair of heater rollers 83*a*, 83*b* is provided on the upstream side of the carrying direction of the package sheet 61 with respect to the feed rollers 82*a*, 82*b*. Each of the heater rollers 83*a*, 83*b* has: a disk-shaped feed heat sealing member 84; and a thin rectangular plate-shaped longitudinal heat sealing member 86 formed on the bottom integrally with a roller member 85 having the same diameter as that of the feed heat sealing member 84. The feed heat sealing members 84, 84 are rotatably driven by a driving mechanism (not shown) including the common motor with the motor for the feed rollers 82*a*, 82*b*. The longitudinal heat sealing members 86, 86 are rotatably driven by a driving mechanism different from the mechanism for the feed heat sealing members 84, 84. A longitudinal seal (horizontal seal) is formed at the side edge of the package sheet 61 between the feed heat sealing members 84, 84. A seal across the package sheet 61 (vertical seal) is formed by the longitudinal heat sealing members 86, 86 of the heater roller 83*a*, 83*b*.

With further reference to FIGS. 19 to 24, the unfolding guide 65 is described in detail. The unfolding guide 65 includes, a guide body 91 having the functions of expanding the package sheet 61 folded in half and forming an opening for insertion of the feed port 67*a* of the hopper 67, and a long slender plate-shaped fixing section 93 for fixing this guide body 91 to the front holding section 71*a* of the holding frame 71 through the bracket 92. The unfolding guide 65 is fixed to the bracket 92 by screws (not shown) inserted through the respective through holes 93*a*, 93*b* in the fixing section 93.

The guide body 91 of the unfolding guide 65 includes, a main edge line 94 extending along a fold line of the package sheet 61, a pair of unfolding guide surfaces 90*a*, 90*b* that are curved surfaces extending from the main edge line 94 and having a convex shape seen from the carrying direction of the package sheet 61 (refer to an arrow "A" in FIGS. 23 and 24) and symmetrical to each other with respect to the main edge line 94, a sub-edge line 95 extending continuously with the main edge line 94 from the end of the main edge line 94 on the upstream side of the carrying direction "A" of the package sheet 61, a pair of top surfaces 96*a*, 96*b* that are curved surfaces extending from the sub-edge line 95 and having a convex shape seen from the upstream side of the carrying direction "A" of the package sheet 61 and symmetrical to each other with respect to the sub-edge line 95, and rear end edges 97*a*, 97*b* of the unfolding guide surfaces 90*a*, 90*b* extending from the end of the main edge line 94 on the downstream side of the carrying direction of the package sheet 61. When seen from the upstream side of the carrying direction "A" of the package sheet 61, the guide body 91 has the shape of a generally smooth curved surface and becomes narrower toward the downstream side of the carrying direction "A" of the package sheet 61 (extending toward the upstream side of the carrying direction "A" of the package sheet 61). On the other hand, when seen from the downstream side of the carrying direction "A" of the package sheet 61, the guide body 91 has a concave shape or a depressed shape, and this depression is closed by a closing plate 98 schematically shown only in FIG. 19 so that medicines (especially powdered medicines) are not stacked in this depression.

Figure 20:
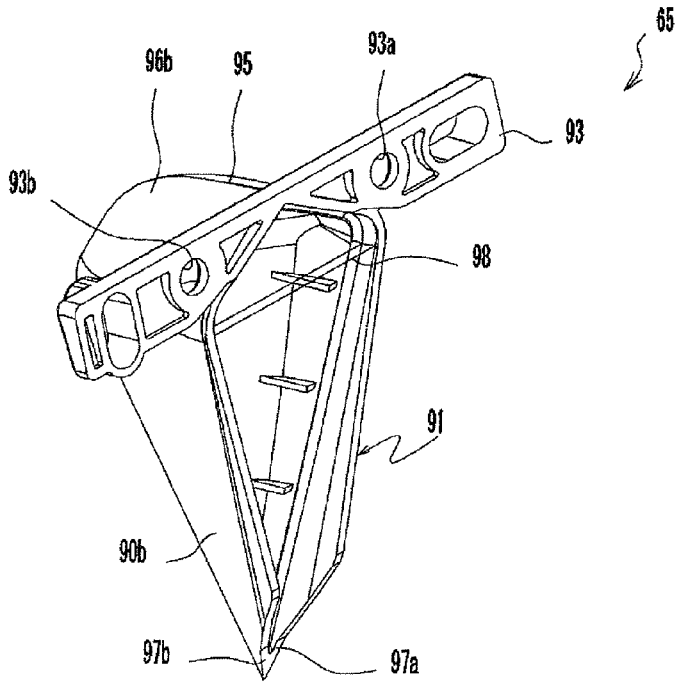
FIG. 20 is a perspective view of an unfolding guide seen from a rear side.
Figure 21:
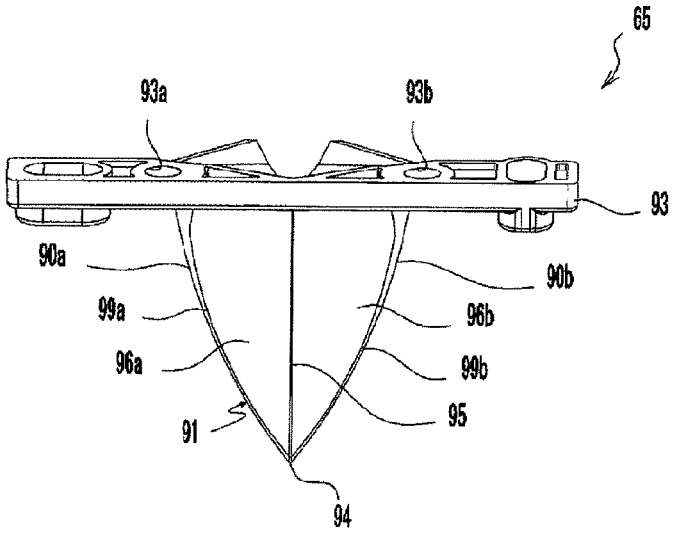
FIG. 21 is a plan view of the unfolding guide.
Figure 22:
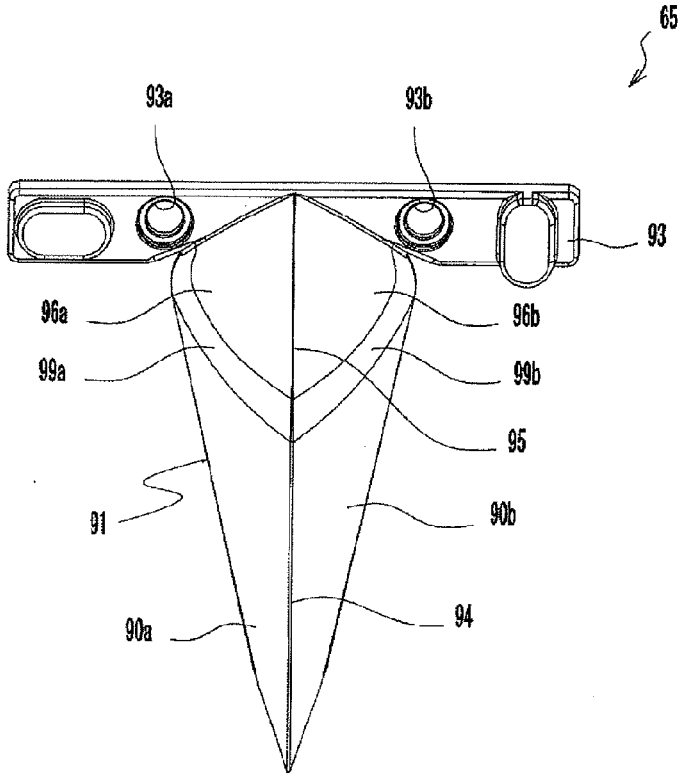
FIG. 22 is a front view of the unfolding guide.

When seen from the carrying direction "A" of the package sheet 61, the appearance of the unfolding guide surfaces 90*a*, 90*b* is a convex-shaped curved line and the space between the pair of the unfolding guide surfaces 90*a* and 90*b* is expanded as leaving from the main edge line 94 (refer to FIG. 20). Further, when seen from a direction orthogonal to the carrying direction "A" of the package sheet and also directly opposed to the main edge line 94 (refer to an arrow "B" in FIGS. 23 and 24), the appearance of the unfolding guide surfaces 90*a*, 90*b* has a straight-line shape, and the spaces of the unfolding guide surfaces 90*a* and 90*b* becomes narrower from the upstream side toward the downstream side of the carrying direction "A" of the package sheet 61 (cf. FIG. 21).

The unfolding guide 65 includes such a pair of the unfolding guide surfaces 90*a*, 90*b* of the convex-shaped curved surface and the direction in which the side edge of the guide rod 81 at the downstream side of the carrying direction of the package sheet 61 extends is consistent with the direction in which the main edge line 94 of the unfolding guide 65 extends. With these arrangements, the package sheet 61 folded in half is transformed or unfolded moderately to form the opening by guiding the curved surfaces while evenly acting stress on each half portions of the package sheet 61 folded in half. Therefore, even when the printing section 69 is arranged closely to the unfolding guide 65 and the heat sealing section 68, it is possible to reliably prevent occurrence of wrinkles on the package sheet 61 in the heat sealing section 68. In other words, due to the shape of the unfolding guide 65, it is possible to reduce the distance from the printing section 69 to the heat sealing section 68 without causing occurrence of the wrinkles on the package sheet 61. Consequently, at the time of initial activation of the medicine packaging apparatus 1 or at the time of replacing the roll 62, it is possible to minimize the length of a wasteful package sheet 61 to be used not for packaging medicines but only for wiring or arranging (package sheet from the printing section to the heat sealing section), resulting in reduction in running cost. Further, it is possible to reduce the distance from the printing section 69 to the heat sealing section 68, resulting in reduction in size of the apparatus.

Figure 23:
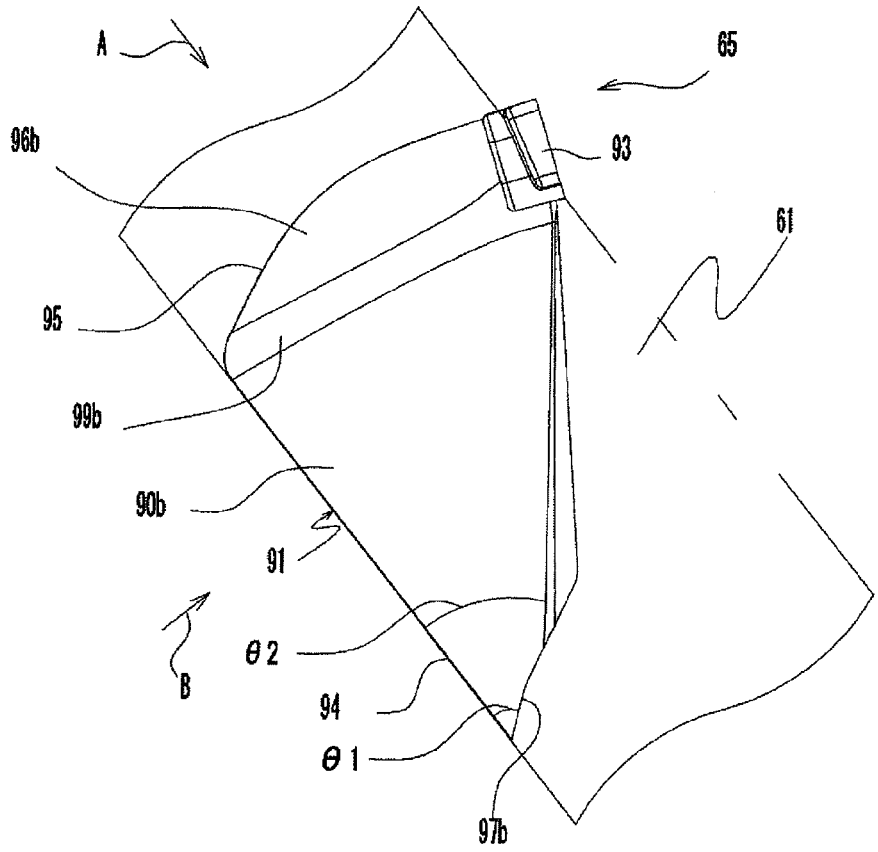
FIG. 23 is a side view showing a relation between the unfolding guide and a package sheet.
Figure 24:
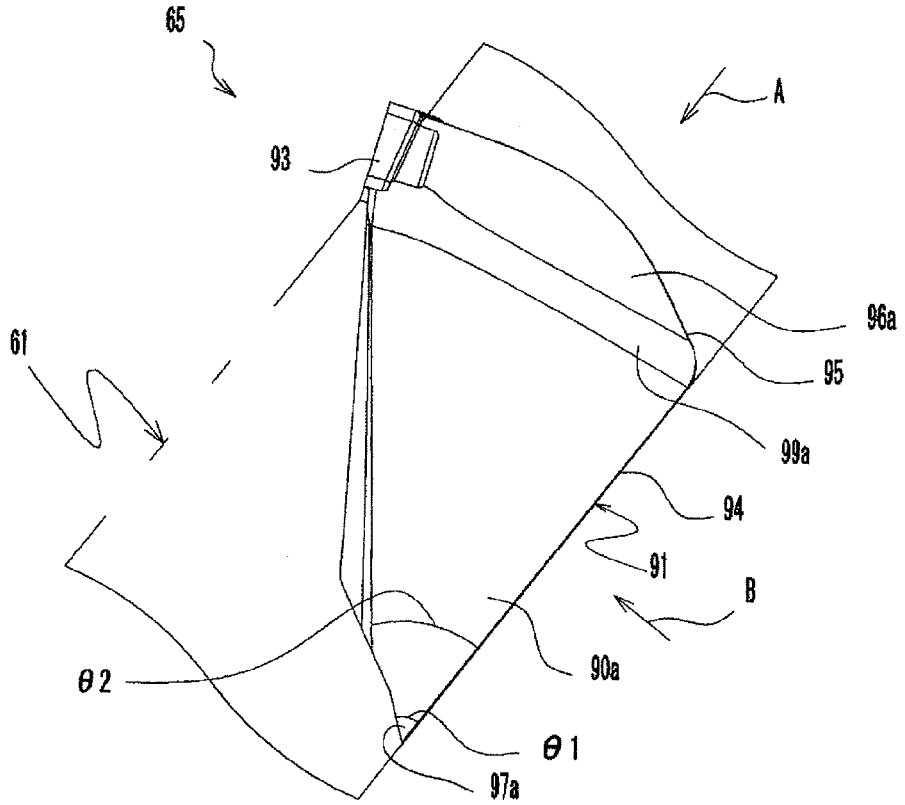
FIG. 24 is a side view showing a relation between the unfolding guide and the package sheet.

As most clearly shown in FIGS. 23 and 24, at the rear end edges 97*a*, 97*b* of the unfolding guide 65, first angles θ1 (e.g. 50 degrees) as acute angles with respect to the main edge line 94 are formed at positions connected with the main edge line 94, and in regions other than the positions connected with the main edge line 94, second angles θ2 (e.g. 60 degrees) larger than the first angles θ1 are formed with respect to the main edge line 94.

With such shapes of the rear end edges 97*a*, 97*b* of the unfolding guide surfaces 90*a*, 90*b*, it is possible to simultaneously achieve prevention of medicines from being stacked and reliable prevention of the occurrence of the wrinkles on the package sheet 61. By setting the first angles θ1, formed at the connecting positions of the rear end edges 97*a*, 97*b* and the main edge line 94, to as small as possible can prevent the medicines (especially powdered medicines) introduced from the feed port 67*a* of the hopper 67 from being stacked at the end of the unfolding guide surfaces 90*a*, 90*b* on the downstream side of the carrying direction "A" of the package sheet 61. On the other hand, in the positions other than the positions where the rear end edges 97*a*, 97*b* are connected with the main edge line 94, the angles formed by both of those are the second angles θ2 larger than the first angles θ1, and it is thereby possible to set the areas of the unfolding guide surfaces 90*a*, 90*b* wide enough to prevent the occurrence of the wrinkles on the package sheet 61.

As described above, the portion of the unfolding guide 65 on the upstream side of the carrying direction "A" of the package sheet 61 is configured of the sub-edge line 95 extending continuously with the main edge line 94 and the pair of the top surfaces 96*a*, 96*b* with the convex-shaped curved surfaces extending symmetrically to each other with respect to the sub-edge line 95. The top surfaces 96*a*, 96*b* are respectively connected with the unfolding guide surfaces 90*a*, 90*b*, and portions where the unfolding guide surfaces 90*a*, 90*b* are connected with the top surfaces 96*a*, 96*b* are formed of curved surfaces 99*a*, 99*b* continuous with the unfolding guide surfaces 90*a*, 90*b* and the top surfaces 96*a*, 96*b*. Even when the medicines (especially powdered medicines) introduced from the feed port 67*a* of the hopper 67 fall onto the top surfaces 96*a*, 96*b* of the unfolding guide due to blowing-up of the medicines or the like, since the top surfaces 96*a*, 96*b* are curved surfaces, the medicines fall into the package sheet 61 through the curved surfaces 99*a*, 99*b* without being built up on the top surfaces 96*a*, 96*b*.

Figure 17:
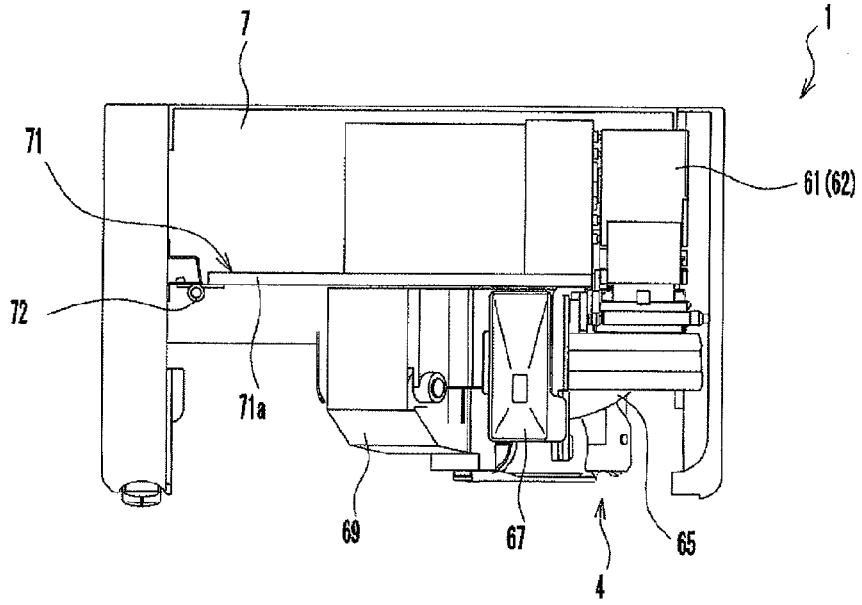
FIG. 17 is a sectional view showing the medicine packaging apparatus with the packaging unit in a state of being at a housed position.
Figure 18:
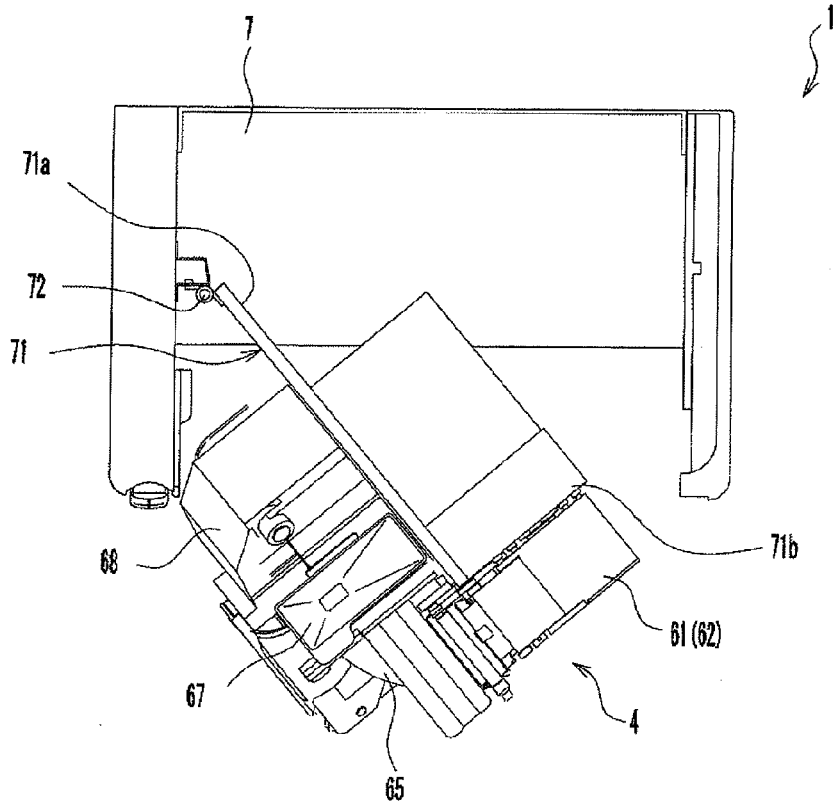
FIG. 18 is a sectional view showing the medicine packaging apparatus with the packaging unit in a state of being at an ejected position.
Figure 19:
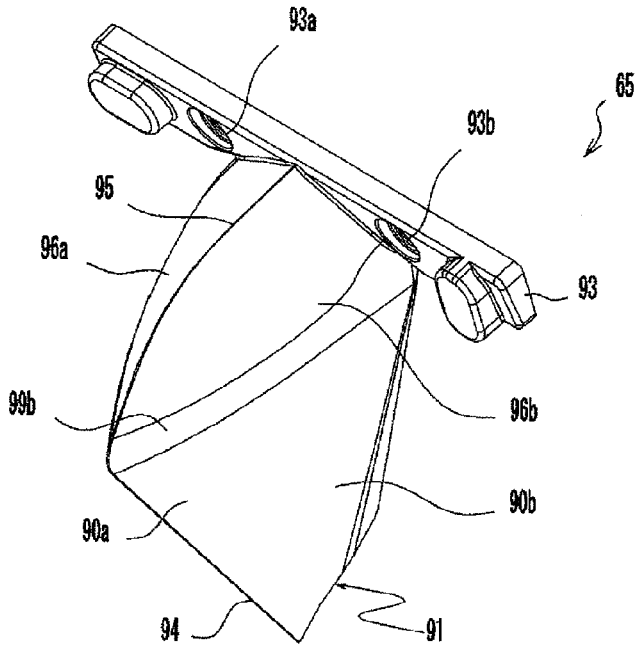
FIG. 19 is a perspective view of an unfolding guide seen from above.

The roll 62 of the package sheet 61, the guide rollers 73*a*, 73*b* and the printing section 69 are arranged in the side holding section 71*b* of the holding frame 71, while the backup roller 79, the guide rod 81, the unfolding guide 65, the hopper 67, and the heat sealing section 68 are arranged in the front holding section 71*a*. As shown in FIG. 17, this allows compact arrangement of the roll 62 of the package sheet 61, the guide rollers 73*a*, 73*b*, the printing section 69, the backup roller 79, the guide rod 81, the unfolding guide 65, the hopper 67, and the heat sealing section 68 using the limited housing space 7 of housing 6. In other words, the size of the medicine packaging apparatus 1 can be reduced. Meanwhile, as shown in FIG. 18, when the holding frame 71 is rotated by the hinge mechanism 72, almost the whole packaging unit 4 is taken out of the housing 6, and the roll 62 of the package sheet 61 and the printing section 69 are moved to the front side of the housing 6. This facilitates access or visual checking from the outside, thereby facilitating various operations such as maintenance of the printing section 69 including replacement of the roll 62 and the ink cartridge 76.

Figure 25:
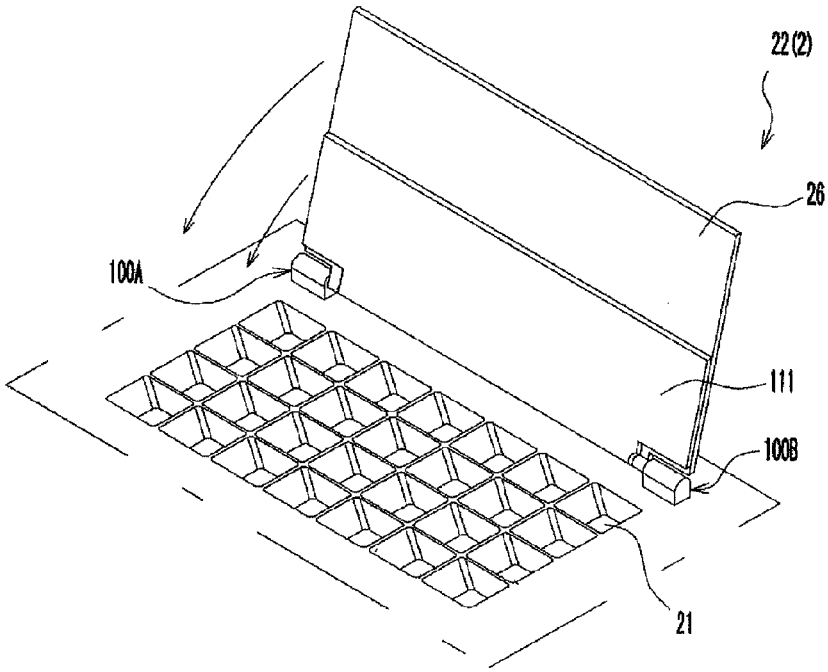
FIG. 25 is a perspective view showing a tablet housing section of a medicine packaging apparatus according to a modified example of the first embodiment.
Figure 26:
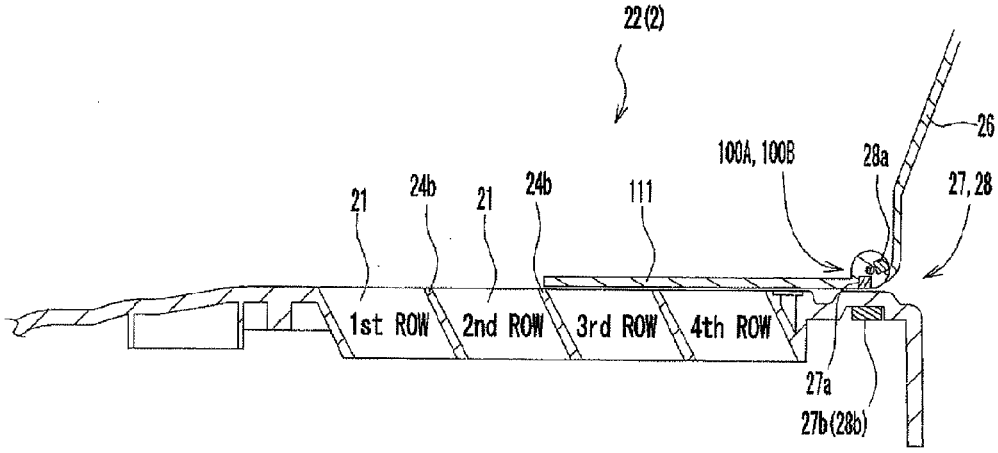
FIG. 26 is a sectional view showing the tablet housing section with a housing space cover in the closed state.

FIGS. 25 and 26 show a closing cover 111 in a modified example of the first embodiment. As shown in FIG. 25, when the closing cover 111 is at the open position, the upper end openings 21*a* of all of the 28 tablet housing chambers 21 are opened and the tablets can be fed into all of the tablet housing chambers 21. On the other hand, as shown in FIG. 26, when the closing cover 111 is at the closed position, the upper end openings 21*a* of seven tablet housing chambers 21 constituting the rearmost-side row and the upper end openings 21*a* of seven tablet housing chambers 21 constituting the second rearmost-side row are closed among the tablet housing chambers 21 in four rows and seven rows, resulting in that the tablets can be fed only into 14 tablet housing chambers 21 in two rows and seven columns. As thus described, the width of the closing cover 111 is set so as to close the tablet housing chambers 21 in the two rearmost-side rows.

Figure 27:
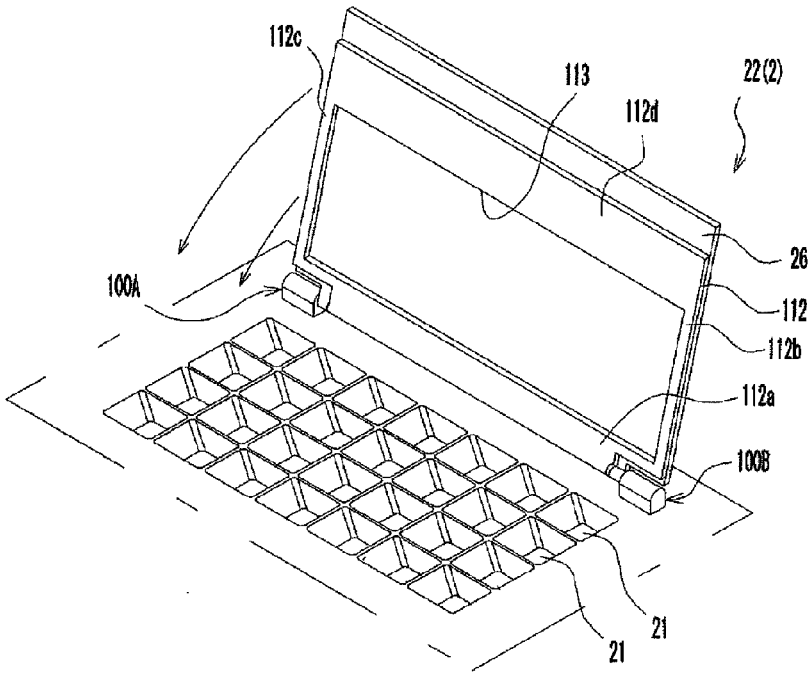
FIG. 27 is a perspective view showing a tablet housing section of a medicine packaging apparatus according to another modified example of the first embodiment.
Figure 28:
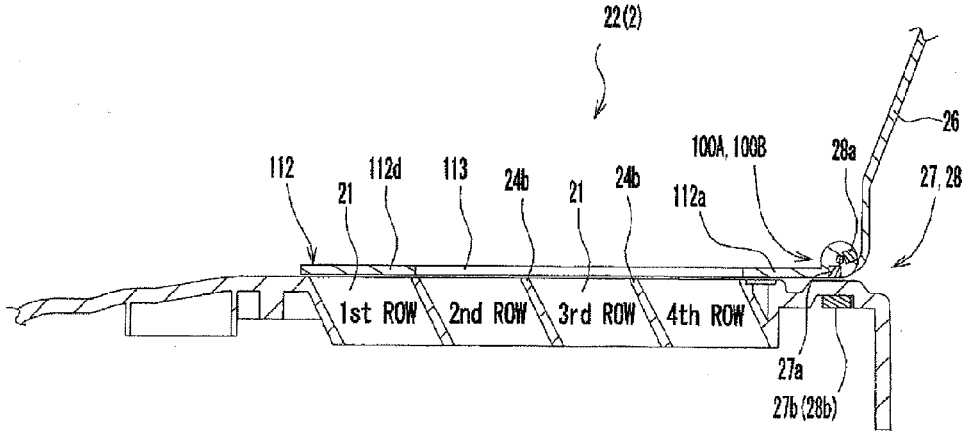
FIG. 28 is a sectional view showing the tablet housing section with a housing space cover in the closed state.

FIGS. 27 and 28 show a closing cover 112 in another modified example of the first embodiment. This closing cover 112 includes, a base section 112*a* rotatably supported by the pin mechanisms 100A, 100B, a pair of extending sections 112*b*, 112*c* extending from this base 112, and a closing section 112*d* connecting the ends of these extending sections 112*b*, 112*c*. The one extending section 112*b* is located to the right side of the tablet housing chamber 21 in the rightmost-side column, whereas the other extending section 112*c* is located to the left side of the tablet housing chamber 21 in the leftmost-side column. In other words, the space between the extending sections 112*b*, 112*c* is set larger than the length of the column direction of the tablet housing chambers 21 (a total of the widths of seven tablet housing chambers 21 in this example). The base section 112*a*, the extending sections 112*b*, 112*c*, and the closing section 112*d* define an opening 113 having a large area. When this closing cover 112 is at the open position, the upper end openings 21*a* of all of the 28 tablet housing chambers 21 are opened and the tablets can be fed into all of the tablet housing chambers 21. On the other hand, when this closing cover 112 is at the closed position, the upper end openings 21*a* of the seven tablet housing chambers 21 constituting the front-side row are closed, and thus the tablets can be fed only into the 21 tablet housing chambers 21 in three rows and seven columns as in the first embodiment.

Second Embodiment

Figure 29:
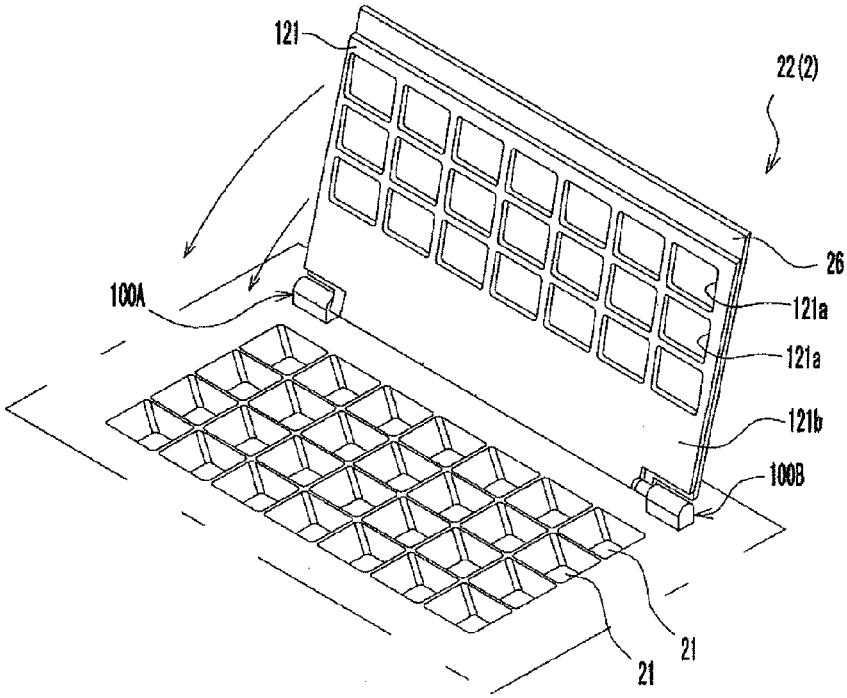
FIG. 29 is a perspective view showing a tablet housing section of a medicine packaging apparatus according to a second embodiment of the present invention.
Figure 30A:
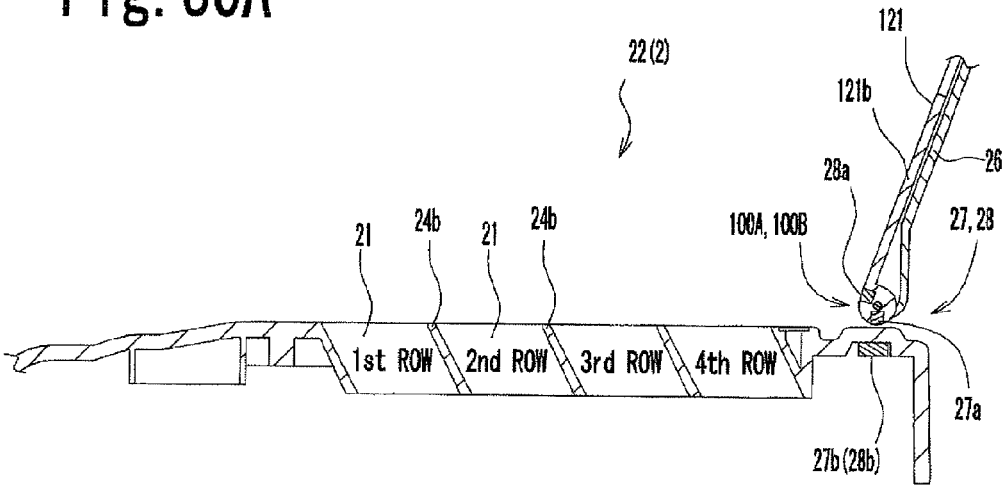
FIG. 30A is a sectional view showing the tablet housing section with a housing space cover in the open state.
Figure 30B:
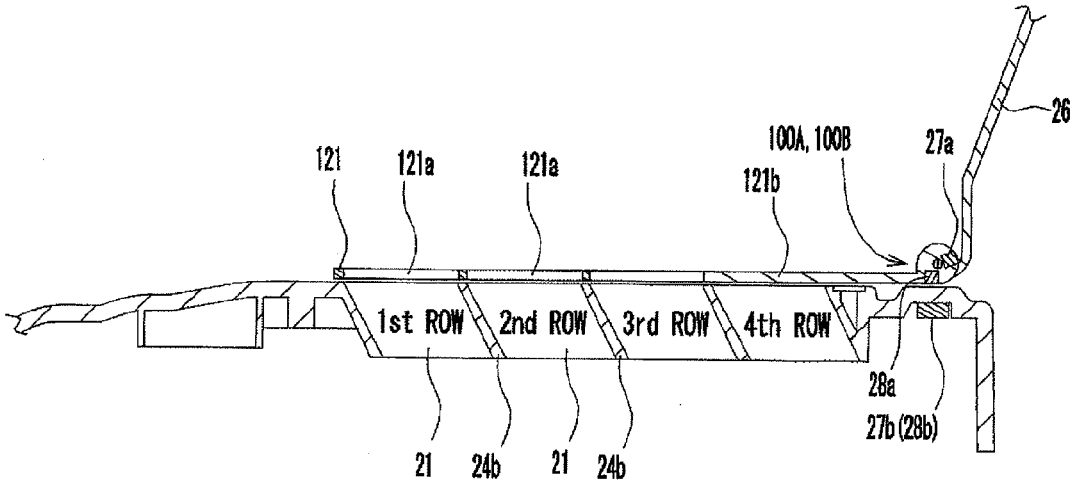
FIG. 30B is a sectional view showing the tablet housing section with the housing space cover in the closed state.
Figure 31A:
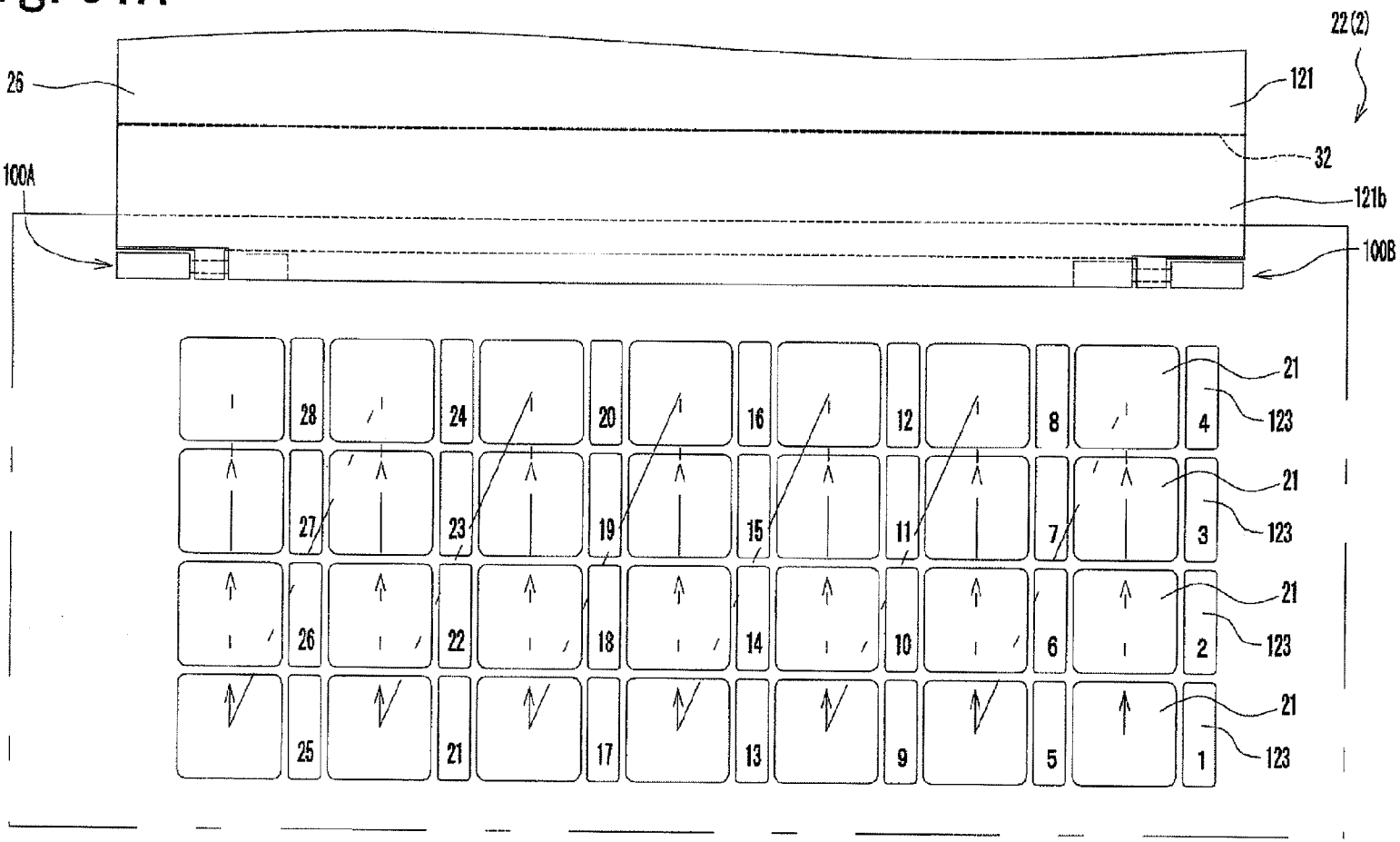
FIG. 31A is a plan view showing the tablet housing section with the housing space cover in the open state.
Figure 31B:
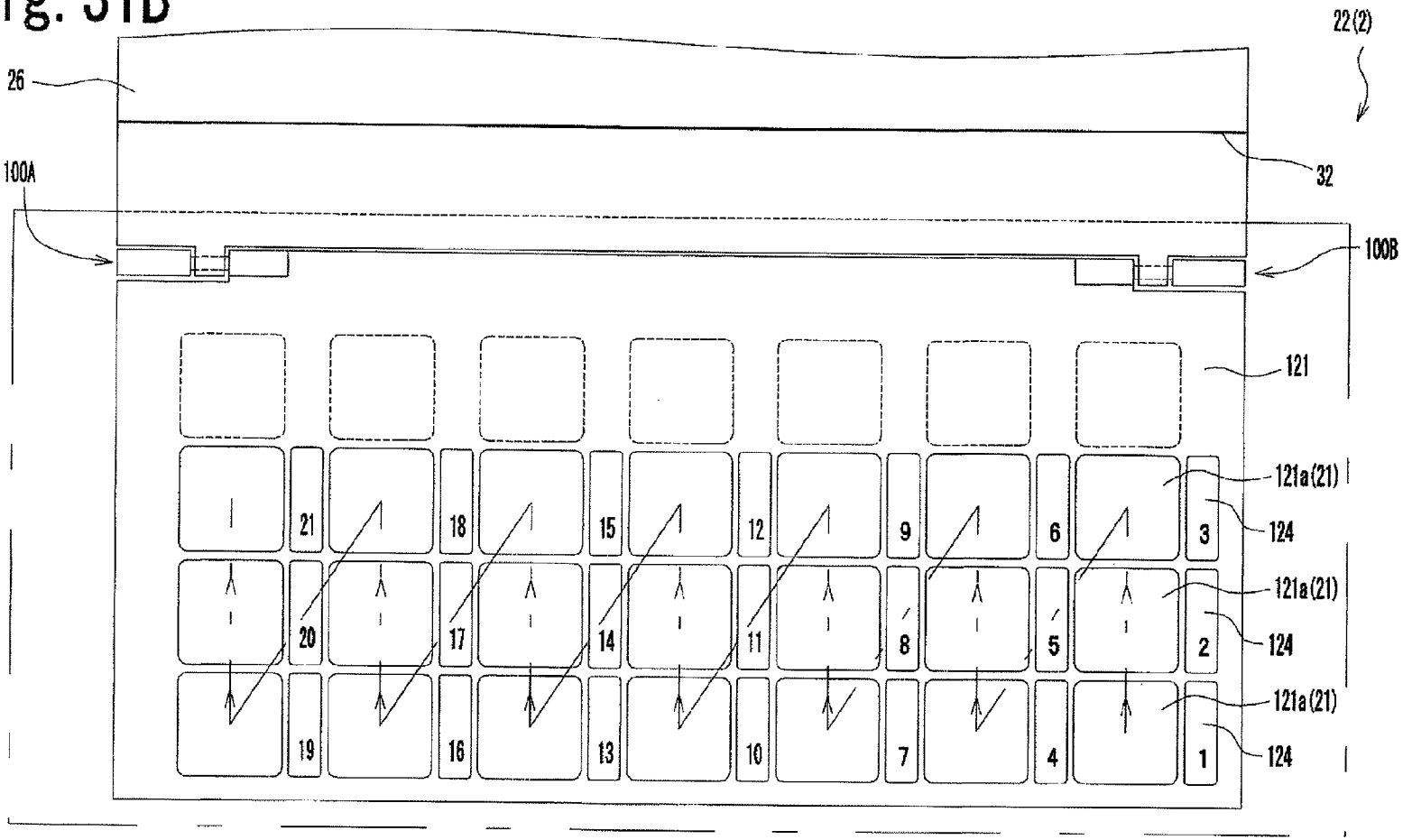
FIG. 31B is a plan view showing the tablet housing section with the housing space cover in the closed state.

FIGS. 29 to 31B show the tablet housing section 22 of the tablet supply unit provided in the medicine packaging apparatus according to a second embodiment of the present invention. The configuration and the function of the medicine packaging apparatus 1 in the present embodiment is the same as those in the first embodiment except for the tablet housing section 22 of the medicine packaging apparatus 1. Further, the present embodiment is in common with the first embodiment in that the base side of a closing cover 121 is rotatably supported by the pin mechanism 100A, 100B, the upper end openings 21*a* of all the 28 tablet housing chambers 21 are opened when the closing cover 121 is at the open position as shown in FIGS. 29, 30A, and 31A, and the upper end openings 21*a* of the tablet housing chambers 21 constituting the rearmost-side row among the tablet housing chambers 21 in four rows and seven columns are closed when the closing cover 121 is at the closed position as shown in FIGS. 30B and 31B. However, the present embodiment is different from the first embodiment in that the upper surface of the tablet housing section 22 and the upper surface of the closing cover 121 are provided with number indicating sections 123, 124 that indicate serial numbers corresponding to the order of feeding the tablets into the respective tablet housing chambers 21.

As shown in FIG. 31A, on the upper surfaces of the tablet housing chambers 21, specifically on the upper surfaces of the second partition walls 24*a* that partition the tablet housing chambers 21 adjacently thereto in the column direction, the number indicating sections 123 corresponding to the respective tablet housing chambers are formed. Specifically, the number indicating sections 123 are provided adjacently to the right side of the upper end openings 21*a* of the respective tablet housing chambers 21. The numbers indicated in the number indicating sections 123 of the respective tablet housing chambers 21 indicate the order of feeding the tablets into the tablet housing chambers 21 (cf. chain double-dashed lines in FIG. 31A). Serial numbers of "1" to "28" are allocated from the tablet housing chamber 21 on the front side (the nearest side) of the rightmost-side column toward the tablet housing chamber 21 on the rearmost side (the backmost side) of the leftmost-side column.

With reference to FIGS. 31A and 31B, when the closing cover 121 is set at the closed position, the number indicating sections 123 provided on the upper surface of the tablet housing chambers 21 are hidden below the closing cover 121, coming into the state of being not seen by an operator who performs the manual distribution operation.

With reference to FIGS. 29, 30B and 31B, in the closing cover 121, a plurality of openings 121*a* penetrating in the thickness direction is formed in matrix form. The shape, size, and arrangement of each of these openings 121*a* are set such that, when the closing cover 121 is at the closed position (cf. FIGS. 30B and 31B), these openings 121*a* are respectively communicated with the openings 21*a* of the tablet housing chambers 21 in the front-side (near-side) three rows and seven columns (a total of 21 chambers) among the tablet housing chambers 21 in four rows and seven rows to allow the tablets pass. Specifically, the shape, size, and arrangement of the opening section 121*a* is set such that the edge of the opening section 121*a* is almost consistent with the edge of the upper end opening 21*a* of the tablet housing chamber 21 in a plan view when the closing cover 121 is at the closed position. Meanwhile, the closing section 121*b* not provided with an opening is arranged on the side closer to the base end than the openings 124 of the closing cover 121 in order to close the tablet housing chambers 21 in the rearmost-side (backmost-side) row when the closing cover 121 is at the closed position.

As shown in FIG. 31, on the upper surface of the closing cover 121, the number indicating sections 124 are provided. Specifically, the number indicating sections 124 are provided, so as to be adjacent to the right side of the upper end openings 21*a* of the respective tablet housing chambers 21 when the closing cover 121 is closed. When the closing cover 121 is at the closed position, the upper end openings 21*a* of the tablet housing chambers 21 in the rearmost-side (backmost-side) row are covered by the closing cover 121, and the upper end openings 21*a* of the tablet housing chambers 21 in three rows and seven columns (a total of 21 chambers) are open through the opening sections 121*a* of the closing cover 121. The number indicating sections 124 are provided so as to be adjacent to the right side of the upper end openings 21*a* of the tablet housing chambers 21 that are open when the closing cover 121 is at the closed position. The numbers indicated in the number indicating sections 124 of the opened tablet housing chambers 21 respectively indicate the order of feeding the tablets into the tablet housing chambers 21 (refer to chain double-dashed lines in FIG. 31B). Serial numbers of "1" to "21" are allocated to the tablet housing chambers 21 from the one on the front side (the nearest side) of the rightmost-side column toward the one on the rearmost side (the backmost side) of the leftmost-side row.

When the closing cover 25 is at the closed position (FIGS. 30B, 31B), the tablets can be housed into the tablet housing chambers 21 in three rows and seven rows (21 chambers), and thereby, in the case of the three times daily dosage, it is possible to execute the operation of manually distributing the tablets into the respective tablet housing chambers 21 in efficient and reliable manner without causing the feeding error. In particular, since the serial numbers of "1" to "21" are indicated for 21 tablet housing chambers 21 in the number indicating sections 124 provided on the closing cover 121, referring to these serial numbers allows execution of the manual distribution operation in a more efficient and more reliable manner without a feeding error. On the other hand, when the closing cover 121 is at the open position (FIGS. 30A, 31B), the tablets can be housed into the tablet housing chambers 21 in four rows and seven columns (28 chambers), and thereby, in the case of the four times daily dosage or the two times daily dosage, it is possible to execute the operation of manually distributing the tablets into the respective tablet housing chambers 21 in an efficient and reliable manner without a feeding error. In particular, since the serial numbers of "1" to "28" are indicated for the 28 tablet housing chambers 21 in the number indicating sections 123 provided on the upper surface of the tablet housing section 22, referring to these serial numbers allows execution of the manual distribution operation in a more efficient and more reliable manner without the feeding error.

Assuming that only the number indicating sections 123 are provided on the upper surface of the tablet housing section 22, the numbers allocated to the tablet housing chambers 21 in three rows and seven columns are not serial when the closing cover 121 is closed. Specifically, when the closing cover 121 is at the closed position, the tablet housing chambers 21 on the rearmost (backmost) side and the number indicating sections 123 adjacent thereto are hidden on the down side of the closing cover 121. As a result, the numbers allocated to the tablet housing chambers 21 are an array of integers lacking multiple numbers of four. However, in the present embodiment, when the closing cover 121 is at the open position, the numbers are allocated to the tablet housing chambers 21 by the number indicating sections 123 on the upper surface of the tablet housing section 22, and when the closing cover 121 is at the closed position, the numbers are allocated by the number indicating sections 124 of the closing cover 121. This results in constant allocation of serial numbers to the tablet housing chambers 21 regardless of whether the closing cover 121 is at the open position or the closed position, thereby supporting the operation of manually distributing the tablets in extremely efficient manner.

The number indicating sections 123, 124 may be thin films or sheets made of paper, a resin or the like which adhere or are bonded to the upper surfaces of the tablet housing section 22 and the closing cover 121, may be provided such that the upper surfaces of the tablet housing section 22 and the closing cover 121 are partially colored, or may be concave sections or convex sections formed on the upper surfaces of the tablet housing section 22 and the closing cover 121.

Along with the number indicating sections 123, 124, or in place of the number indicating sections 123, indication sections indicating the order of feeding the tablets based upon colors, patterns, symbols, letters, or combinations of two or more kinds of these and numbers may be provided on the upper surfaces of the tablet housing section 22 and the closing cover 121.

The configuration and the operation of the medicine packaging apparatus in the second embodiment are the same as those in the first embodiment except for the tablet housing section 22 of the medicine packaging apparatus.

Third Embodiment

FIGS. 32 to 36C show the medicine packaging apparatus 1 according to a third embodiment of the present invention. The configuration and the function of the medicine packaging apparatus 1 in the present embodiment is the same as those in the first embodiment except for the tablet housing section 22 of the tablet supply unit 2.

Figure 32:
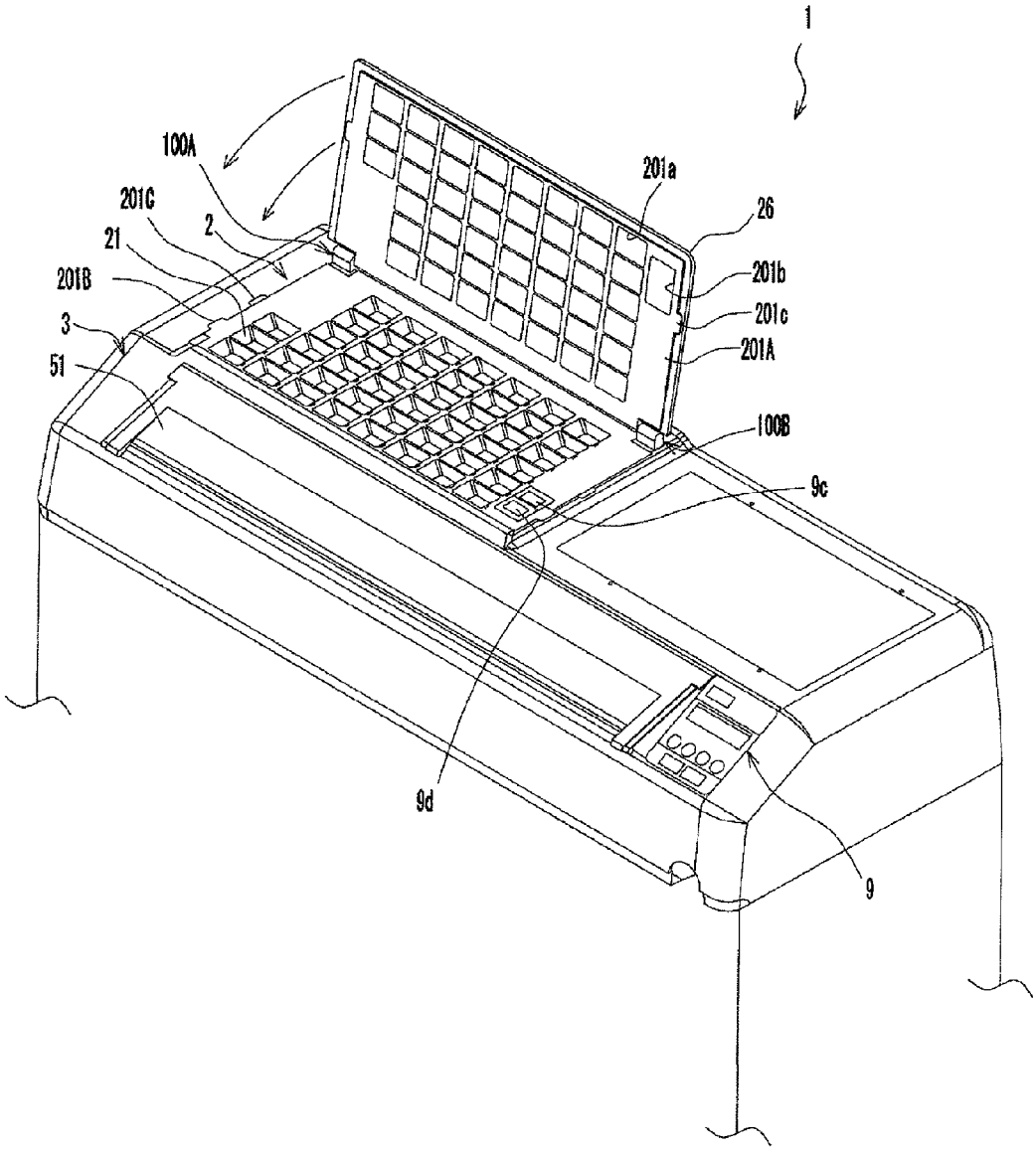
FIG. 32 is a perspective view seen from the front side showing an appearance of a medicine packaging apparatus according to a third embodiment of the present invention.
Figure 33:
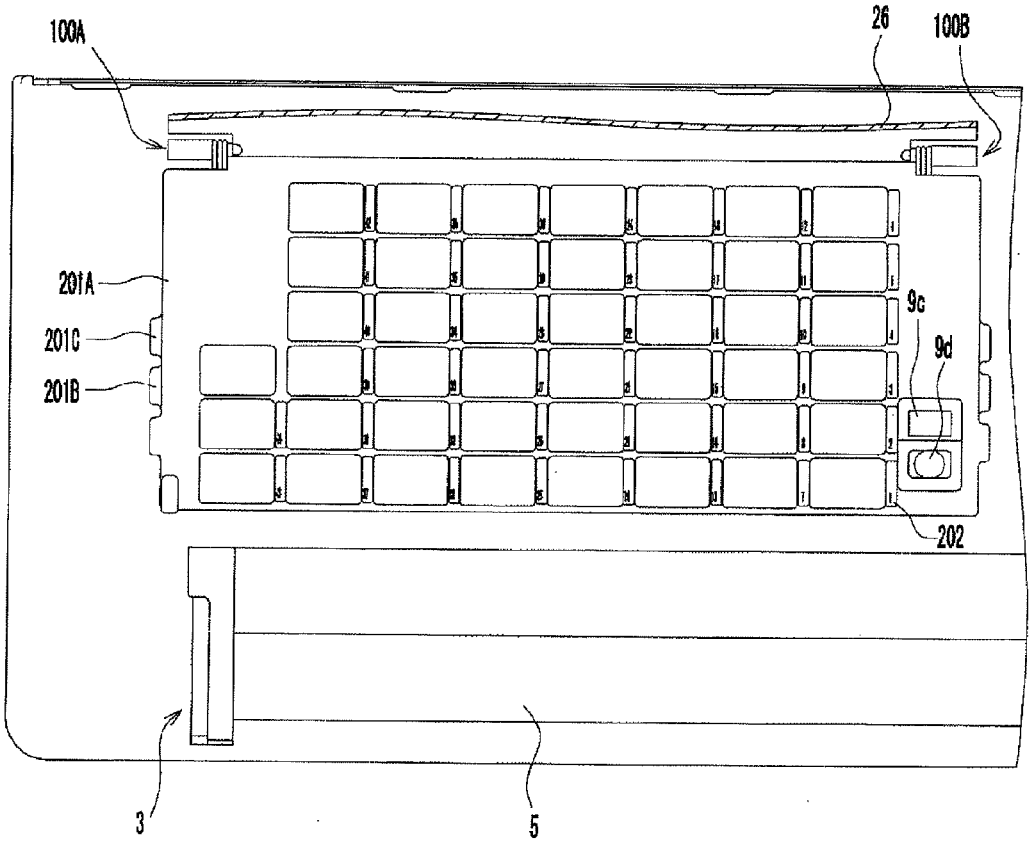
FIG. 33 is a partial plan view showing the tablet housing section.

With reference to FIGS. 32 and 33, in the tablet housing section 22 according to the present embodiment, a total of 42 tablet housing chambers 21, which have an identical shape, are provided in six rows in the anteroposterior direction (row direction) and seven rows in the lateral direction (column direction). Further, three tablet housing chambers 21 are provided adjacently to the tablet housing chambers 21 in the leftmost-side column. Therefore, the tablet housing section 22 in the present embodiment has a total of 45 tablet housing chambers 21. Some switches including the number-of-packs indicating section 9*c* and the start button 9*d* (provided as part of the control panel 9 in the first embodiment) are provided on the upper surface of the tablet housing section 22 adjacent to the lower right of the tablet housing chambers 21 arranged in matrix manner.

Figure 34:
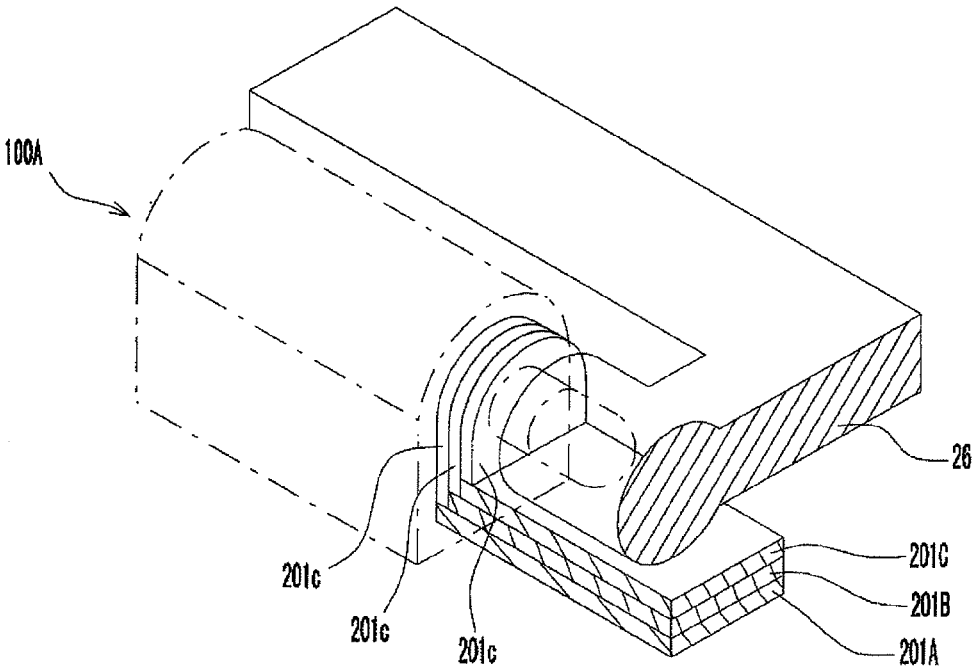
FIG. 34 is a schematic perspective view showing a mechanism of a periphery of a hinge.

With reference to FIGS. 32 and 33, the tablet housing section 22 is provided with three manual distribution sheets (manual distribution supporting members) 201A, 201B, 201C generally in sheet shape or plate shape. With further reference to FIG. 34, these manual distribution sheets 201A to 201C are rotatably attached to the upper surface of the tablet housing section 22 by the pin mechanisms 100A, 100B along with the protection cover 26. As shown in FIG. 34, both ends of the base end side of each of the manual distribution sheets 201A to 201B are provided with tab-shaped sections 201*a*, and the pin mechanisms 100A, 100B are inserted in holes provided in the tab-shaped sections 201*a*.

Among the three manual distribution sheets 201A to 201C, the manual distribution sheet 201A is a sheet for use in the case of the three times daily dosage. Hereinafter, the manual distribution sheet 201A may be referred to as a "three-times-a-day manual distribution sheet" if necessary. Further, the manual distribution sheet 201B is a sheet for use in the case of the four times daily dosage. Hereinafter, the manual distribution sheet 201B may be referred to as a "four-times-a-day manual distribution sheet" if necessary. Moreover, the manual distribution sheet 201C is a sheet for use in a case of the dosaging times beside three times a day and four times a day, for example, in a case of the dosaging times being five times daily dosage (medicines of one-day portion are divided into five and taken separately) or six times daily dosage (medicines of one-day portion are divided into six and taken separately). Hereinafter, the manual distribution sheet 201C may be referred to as a "free manual distribution sheet" if necessary.

When all of the manual distribution sheets 201A to 201C are at the open position, the manual distribution sheets 201A to 201C are arranged so as to be in the order of the free manual distribution sheet 201C, the four-times-a-day manual distribution sheet 201B and the three-times-a-day manual distribution sheet 201A from the front side (near side) toward the rear side (back side). Therefore, as most clearly shown in FIG. 34, when all of the manual distribution sheets 201A to 201C are at the closed position, the sheets are arranged as superimposed in the order of the free manual distribution sheet 201C, the four-times-a-day manual distribution sheet 201B, and the three-times-a-day manual distribution sheet 201C. This order of arranging the manual distribution sheets 201A to 201B is decided in consideration of the most frequent use of the three-times-a-day manual distribution sheet 201A in general. However, the order of arranging the manual distribution sheets 201A to 201B may be arbitrarily changed according to need.

Figure 35A:
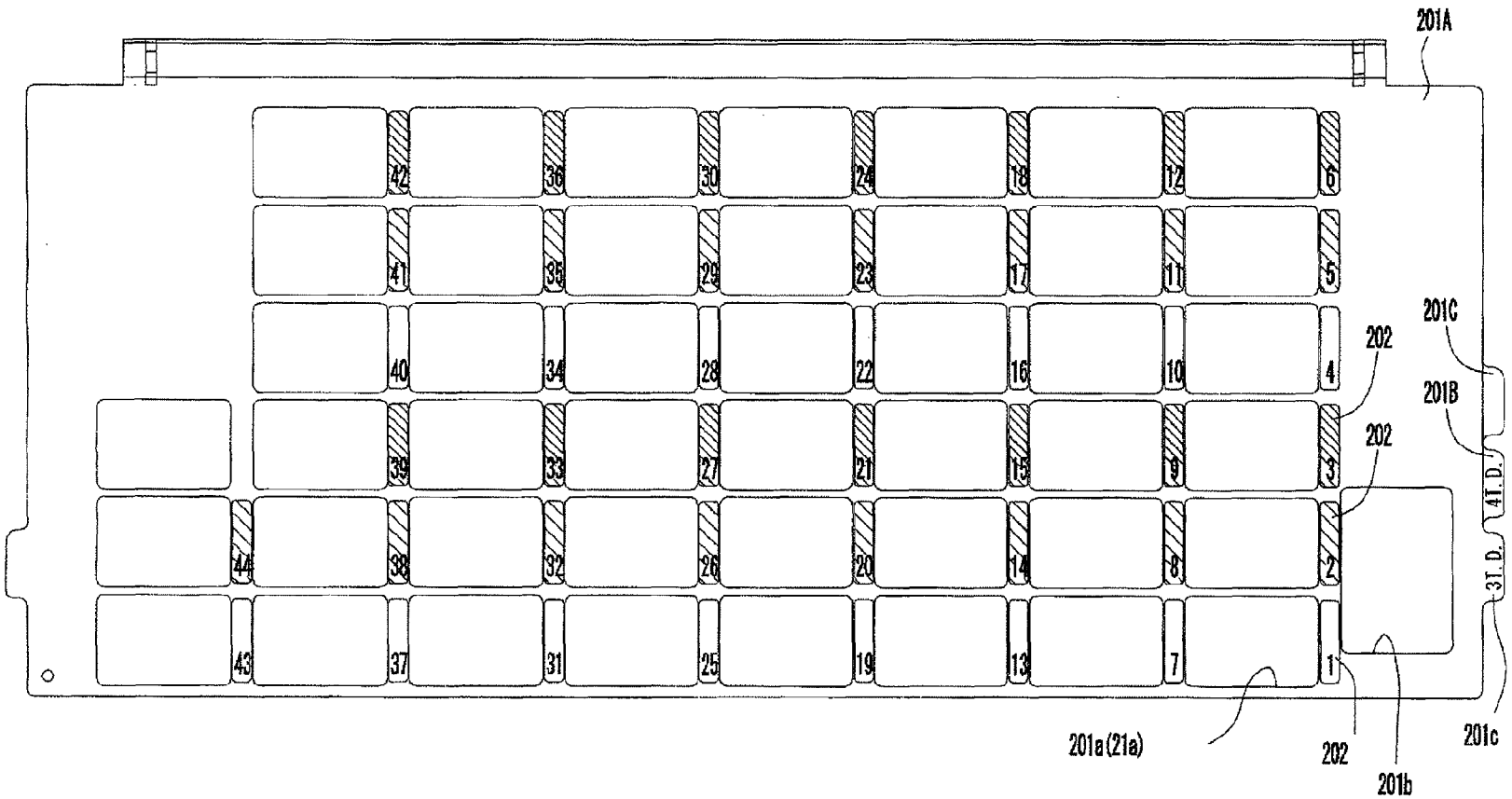
FIG. 35A is a plan view of the tablet housing section in a state where a free cover, a cover for four times daily dosage, and a cover for three times daily dosage are all in the closed state.
Figure 35B:
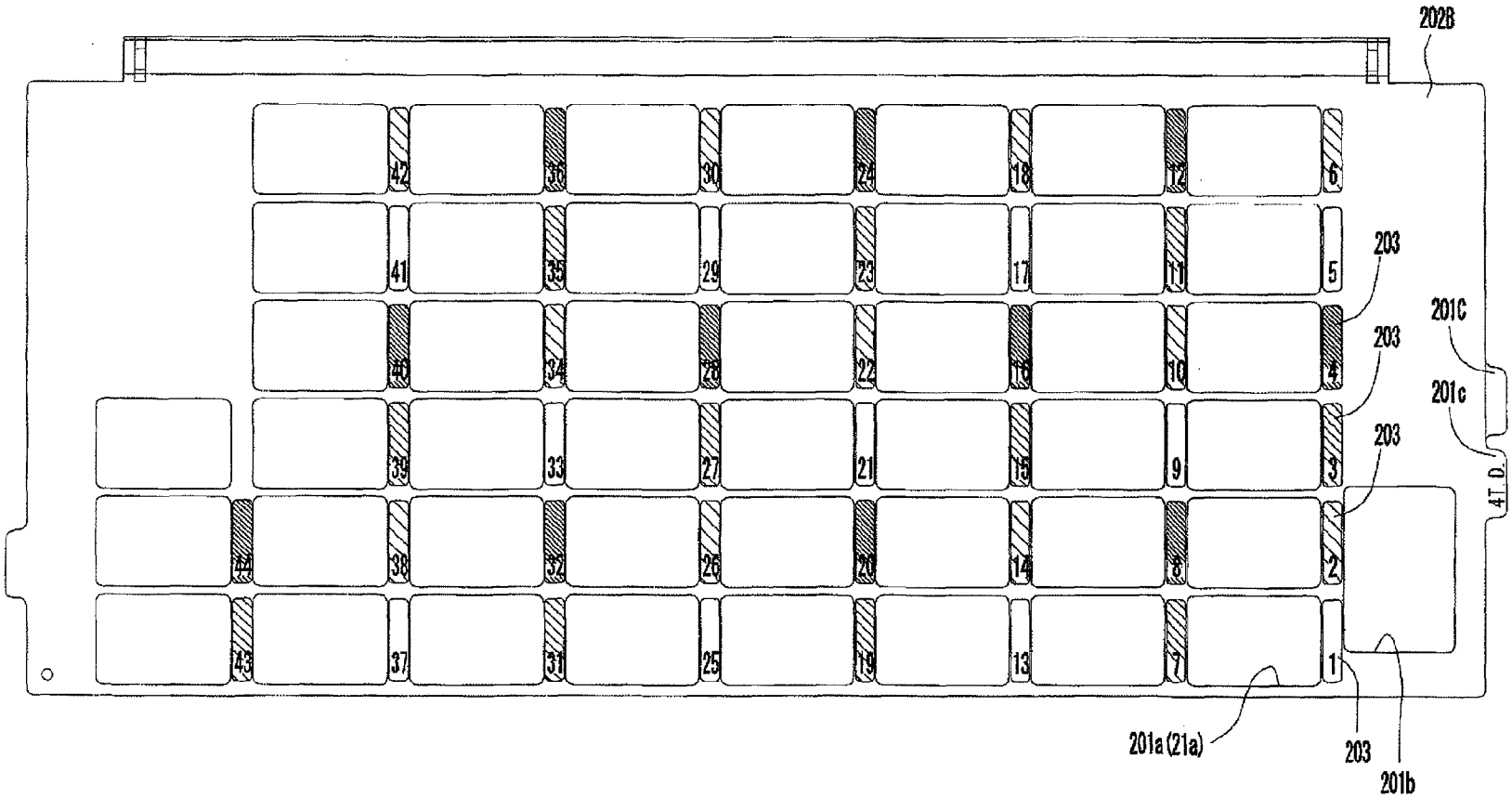
FIG. 35B is a plan view of the tablet housing section in a state where the free cover and the cover for four times daily dosage are in the closed state.

With further reference to FIGS. 35A to 35B, on the respective manual distribution sheets 201A to 201C, a total of 45 openings 201*a* penetrating in the thickness direction are formed in matrix form, corresponding to a total of 45 tablet housing chambers 21 provided in the tablet housing section 22. Specifically, each of the manual distribution sheets 201A to 201C is provided with a total of 42 openings 201*a* in six longitudinal rows and seven lateral columns, and three openings 201*a* adjacent to the openings 201*a* in the leftmost-side column. The shape, size, and arrangement of each of these openings 201*a* are set such that these openings 201*a* are communicated with the upper end openings 21*a* of the corresponding tablet housing chambers 21 when the respective manual distribution sheets 201A to 201C are at the closed position. Specifically, the shape, size and arrangement of the opening 201*a* is set such that the edge of the opening 201*a* is almost coincident with the edge of the upper end opening 21*a* of the tablet housing chamber 21 in a plan view when the respective manual distribution sheets 201A to 201C are at the closed position.

In the manual distribution sheets 201A to 201C, windows 201*b* each having the same shape, size and arrangement and penetrating in the thickness direction are formed, so as to allow operation and checking of the number-of-packs indicating section 9*c*, the start button 9*d* and the like, even with all of the manual distribution sheet 201A at the closed position.

The respective manual distribution sheets 201A to 201C are provided with tabs 201*c* to be pinched by the operator to facilitate manual shifting of the position from the open position to the closed position as well as shifting in the reverse direction. As most clearly shown in FIG. 35A, the positions of the tabs 201*c* of the three manual distribution sheets 201A to 201C are set so as not to be mutually overlapped even when the manual distribution sheets 201A to 201C are at the closed position. Further, on the tabs 201*c* of the three-times-a-day manual distribution sheet 201A and the four-times-a-day manual distribution sheet 201B, the dosaging times (three times daily, four times daily) are indicated as the names of the sheets.

Figure 35C:
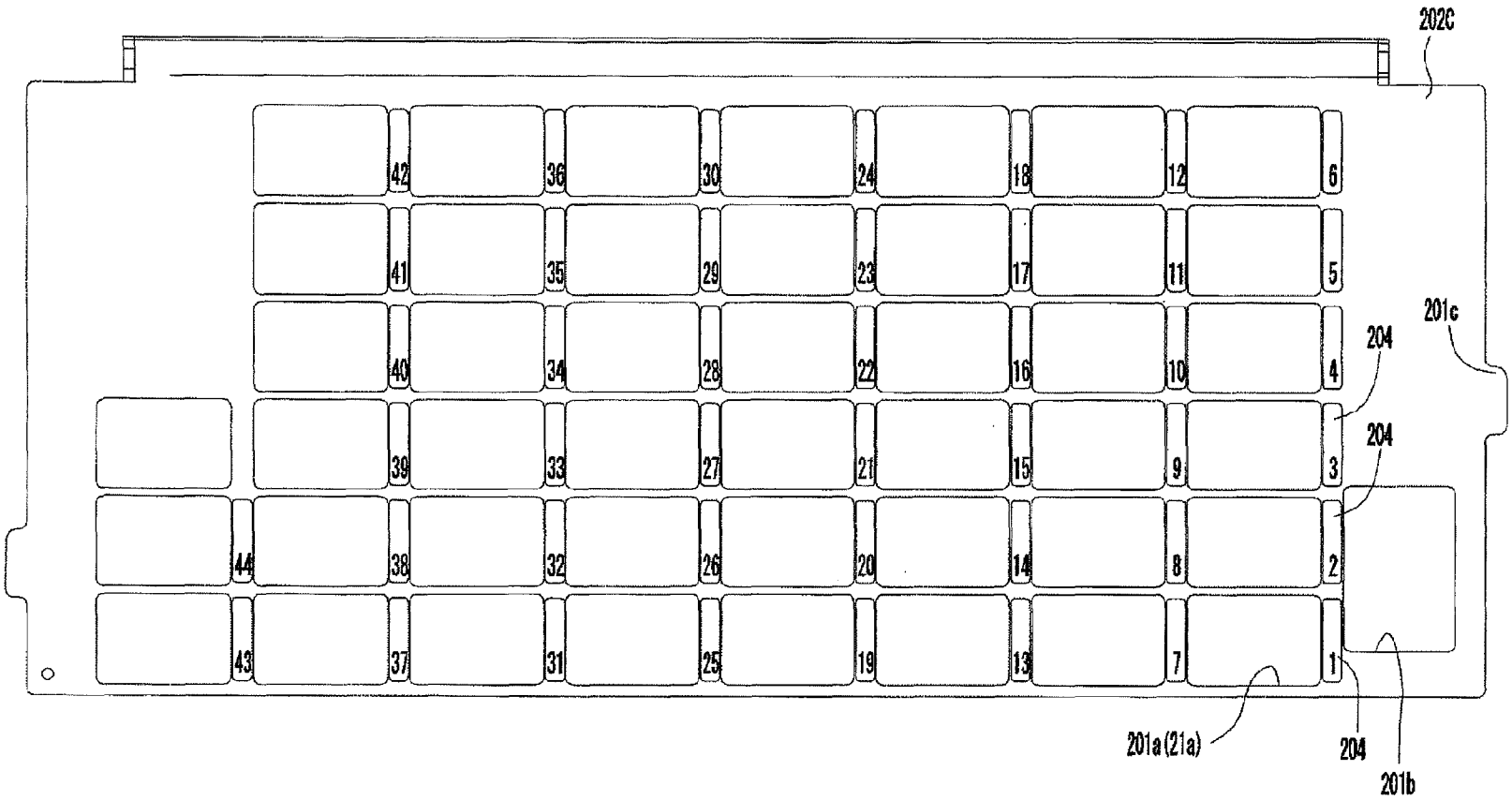
FIG. 35C is a plan view of the tablet housing section in a state where only the free cover is in the closed state.

With reference to FIGS. 35A to 35C, the upper surfaces of the manual distribution sheets 201A to 201 are provided with number indicating sections 202, 203, 204 adjacent to the right side of the openings 201*a*. The numbers indicated in these number indicating sections 202 to 204 indicate the order of feeding into the tablet housing chamber 21. Serial numbers of "1" to "44" are sequentially allocated to the openings 201*a* from the one corresponding to the tablet housing chamber 21 on the front side (the nearest side) of the rightmost-side column.

The number indicating sections 203 of the three-times-a-day manual distribution sheet 201A are regularly color-coded in order to facilitate the operation of manually distributing the tablets into the respective tablet housing chambers 21 in the case of the three times daily dosage (e.g. taking a certain medicine in a total of three times a day, morning, afternoon and evening). Further, the four-times-a-day manual distribution sheet 201B are regularly color-coded in order to facilitate the operation of manually distributing the tablets into the respective tablet housing chambers 21 in the case of the four times daily dosage (e.g. taking a certain medicine in a total of four times a day, morning, afternoon, evening and bedtime). In FIGS. 35A and 3513, the color coding is expressed by densities of hatching added to the number indicating sections 203, 204 and the presence or absence of the hatching.

With reference to FIG. 35A, the number indicating sections 203 of the three-times-a-day manual distribution sheet 201A are color-coded by repletion of three colors, blue, red and green. Specifically, the number indicating sections 203 each indicating one or a sum of one and a multiple number of three (1, 4, 7, 1, 10 . . . ) are colored blue. Further, the number indicating sections 203 each indicating two or a sum of two and a multiple number of three (2, 5, 8, 11, 14 . . . ) are colored red. Moreover, the number indicating sections 203 each indicating a multiple number of three (3, 6, 9, 12, 15 . . . ) are colored green. In other words, the order of blue, red, and green is repeated as the number indicated by the number indicating section 203 increases sequentially from one.

With reference to FIG. 35B, the number indicating sections 204 of the four-times-a-day manual distribution sheet 201B are color-coded by repletion of four colors, blue, red, green, and grey. Specifically, the number indicating sections 204 each indicating one or a sum of one and a multiple number of four (1, 5, 9, 13, 17 . . . ) are colored blue. Further, the number indicating sections 204 each indicating two or a sum of two and a multiple number of four (2, 6, 10, 14, 18 . . . ) are colored red. Further, the number indicating sections 204 each indicating three or a sum of three and a multiple number of four (3, 7, 11, 15, 19 . . . ) are colored green. Furthermore, the number indicating sections 204 each indicating a multiple number of four (4, 8, 12, 16, 20 . . . ) are colored grey. In other words, the order of blue, red, green, and grey is repeated as the number indicated by the number indicating section 204 increases sequentially from one.

Different from the number indicating sections 202, 203 of the manual distribution sheets 201A, 201B, the number indicating section 204 of the free manual distribution sheet 201C are not color-coded and all the number indicating sections 204 are identically colored.

Figure 36A:
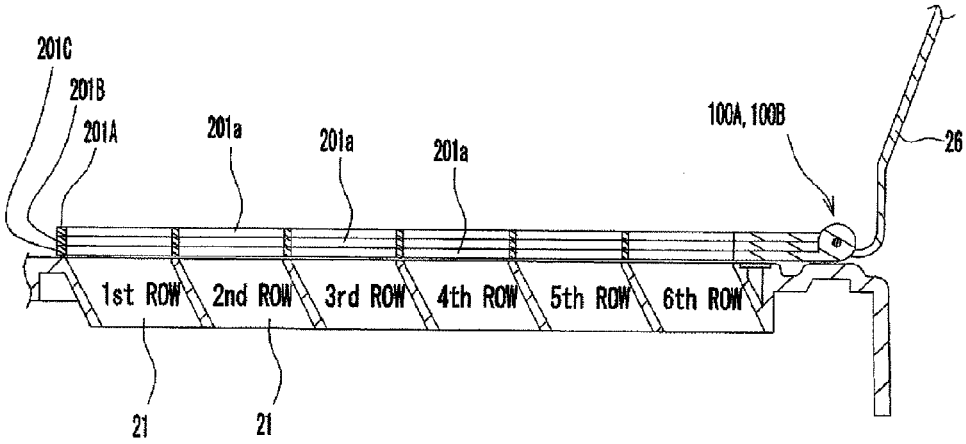
FIG. 36A is a sectional view of the tablet housing section in a state where the free cover, the cover for four times daily dosage, and the cover for three times daily dosage are all in the closed state.

In a case of using the three-times-a-day manual distribution sheet 201A, as shown in FIGS. 35A and 36A, all of the three manual distribution sheets 201A to 201C are set at the closed position. In this state, serial numbers in the number indicating section 203 are indicated adjacently to the respective tablet housing chambers 21, and color-coding patterns (repetition of blue, red, and green) of the number indicating sections 203 are also indicated. Therefore, by referring to the numbers and the color-coding pattern, the operator can execute the operation of manually dividing the tablets in the case of the three times daily dosage in efficient and reliable manner without causing the feeding error.

Figure 36B:
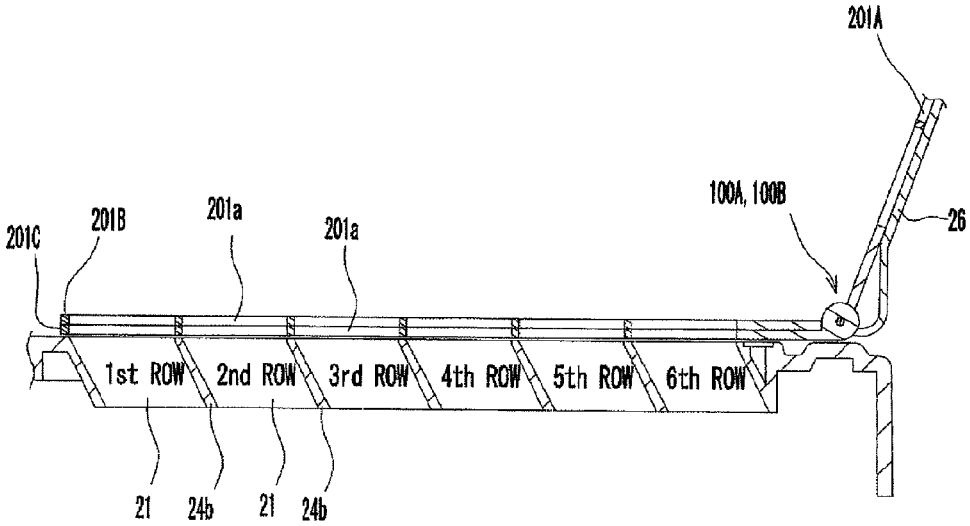
FIG. 36B is a sectional view of the tablet housing section in a state where the free cover and the cover for four times daily dosage are in the closed state.

In a case of using the four-times-a-day manual distribution sheet 201B, as shown in FIGS. 35B and 36B, the three-times-a-day sheet 201A is set at the open position and the four-times-a-day sheet 201B and the free sheet 201C are set at the closed position. In this state, serial numbers in the number indicating section 204 are indicated adjacently to the respective tablet housing chambers 21 and color-coding patterns (repetition of blue, red, green and grey) of the number indicating sections 204 are also indicated. Therefore, by referring to the numbers and the color-coding pattern, the operator can execute the operation of manually dividing the tablets in the case of the four times daily dosage in efficient and reliable manner without the feeding error.

Figure 36C:
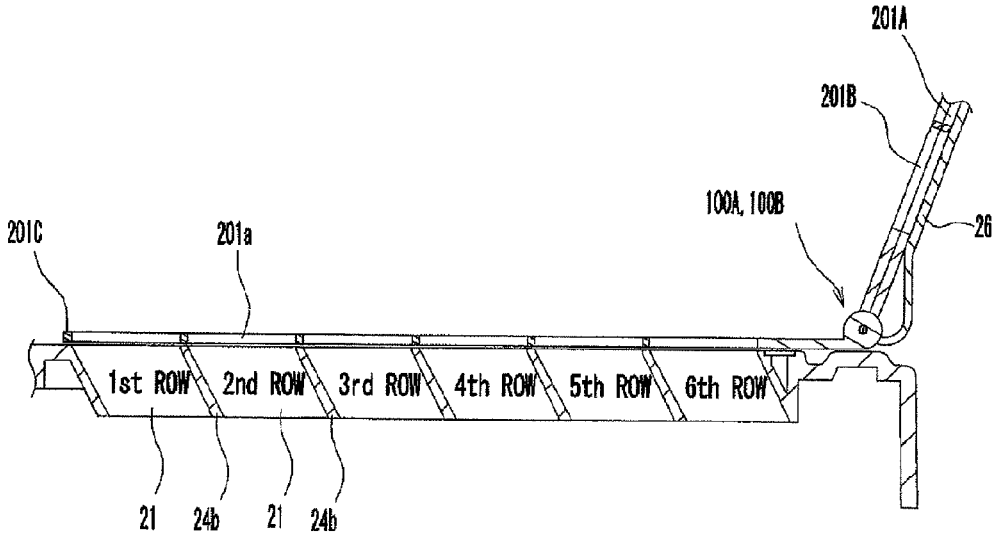
FIG. 36C is a sectional view of the tablet housing section in a state where only the free cover is in the closed state.

In a case of using the free sheet 201C, as shown in FIGS. 35C and 36C, the four-times-a-day sheet 201A and the three-times-a-day sheet 201B are set at the open position and only the free sheet 201C are set at the closed position. In this state, serial numbers not color-coded and having the same color are indicated adjacently to the respective tablet housing chambers 21. Therefore, in a case of relatively special dosaging times, such as five times a day and six times a day, the operator can execute the operation of manually dividing the tablets while referring to the numbers.

As described above, with the use of any of the manual distribution sheets 201A to 201C in accordance with the dosaging time, it is possible to execute the operation of manually distributing the tablets into the respective tablet housing chambers in accordance with the dosaging times in efficient and reliable manner without the feeding error.

The number indicating sections 203 to 204 may be thin films or sheets made of paper, a resin or the like which adhere or are bonded to the upper surfaces of the tablet housing section 22 and the closing cover 121, may be provided such that the upper surfaces of the tablet housing section 22 and the closing cover 121 are partially colored, or may be concave sections or convex sections formed on the upper surfaces of the tablet housing section 22 and the closing cover 121. Further, the number indicating sections 203 to 204 may represent the order of feeding the tablets based upon patterns, symbols, letters, or combinations of two or more kinds of these and numbers.

The operation of manually distributing the tablets to the medicine packaging apparatus 1 of the present embodiment is described by taking as examples cases where a medical prescription includes prescription indicated in the following table.

| Medicine | Dosaging tmes | Dose per day | Dosage days | Total dose |
|---|---|---|---|---|
| Tablet A | Morning, afternoon, evening | 3 times a day, 1 tablet each | 3 days | 9 tablets |
| Tablet B | Morning, evening | Twice a day, 1 tablet each | 3 days | 6 tablets |
| Tablet C | Bed time | Once a day, 2 tablets each | 6 days | 12 tablets |

First, dosaging times are checked with the medical prescription. Since there are four dosaging times of morning, afternoon, evening, and bed time in this prescription, the four-times-a-day manual distribution sheet 201B is selected (cf. FIGS. 35B and 36B). Among the number indicating sections 203 of the four-times-a-day manual distribution sheet 201B, the number indicating section 203 of blue color corresponds to "morning", the number indicating section 203 of red color corresponds to "afternoon", the number indicating section 203 of green color corresponds to "evening", and the number indicating section 203 of gray color corresponds to "bed time".

First, the operation of manually distributing the tablets "A" is performed. The dosaging times for the tablet "A" are morning, afternoon, and evening, and a dose for each time is one tablet. Further, a total dose is nine tablets. Therefore, one tablet "A" is manually fed into each of the tablet housing chambers 21 with the number indicating sections 203 of blue, red, or green sequentially from the chamber with the number of the number indicating section 204 being "1" so that the total of nine tablets. "A" are manually distributed. Next, the operation of manually distributing the tablets "B" is performed. The dosaging times for the tablet "B" are morning and evening, a dose for each time is one tablet. Further, a total dose is six tablets. Therefore, one tablet "B" is manually fed into each of the tablet housing chambers 21 with the number indicating sections 203 of blue or green sequentially from the chamber of the number indicating section 204 being "1" so that the total of six tablets "B" are manually distributed. Finally, the operation of manually distributing the tablets C is performed. The dosaging time for the tablet C is bed time, and a dose for each time is two tablets. Further, a total dose is twelve tablets. Therefore, two tablets "C" are manually fed into each of the tablet housing chambers 21 with the number indicating sections 203 of gray sequentially from the chamber with the number of the number indicating section 203 being "4" so that the total of twelve tablets "C" are manually distributed. Although the tablets "A" to "C" are different in dosaging times, referring to the color of the number indicating section 203 allows feeding of the individual tablets A to C into the corresponding tablet housing chambers in an efficient manner without feeding errors.

The other configuration and operation in the third embodiment are the same as those in the first embodiment.

The present invention is not limited to the above-mentioned embodiments but include various modifications. For example, although the closing cover and the manual distribution sheet in the above-mentioned embodiments is movable to the open and closed positions by being rotatably supported by the rotation supporting mechanism, the closing cover and the manual distribution sheet may be movable to the open and closed positions and by being slid with respect to the tablet housing section. Further, the closing cover and the manual distribution sheet may be attached to and detached from the tablet housing section. Moreover, configurations other than that of the tablet supply unit of the medicine packaging apparatus are not limited to those in the embodiments. In other words, the present invention is applicable to various medicine packaging apparatuses other than those in the embodiments as long as the apparatus has the function of manually distributing the tablets.

The invention claimed is:

1. A medicine packaging apparatus, comprising:

a tablet supply section for supplying one or more tablets in a plurality of doses; and a packaging section for packaging the tablets supplied from the tablet supply section, wherein the tablet supply section comprises:

a tablet housing section provided with tablet housing chambers for respectively housing the one or more tablets for one dose fed from upper end openings thereof, the tablet housing chambers being arranged in a plurality of rows in an anteroposterior direction and a plurality of columns in a lateral direction, a cover element for covering the upper end openings of the tablet housing chambers, a medicine discharge section for taking out the one or more tablets housed in the respective tablet housing chambers and sending the one or more tablets in each dose to the packaging section, at least one manual distribution supporting member which is rotatably supported at a base end side by a rotation supporting mechanism arranged on a rear side of a rearmost-side row of the tablet housing chambers, the manual distribution supporting member being arranged at an interior side of the cover element and being manually rotatable about the rotation supporting mechanism between a first position where the member is receded from the tablet housing section and a second position where the member is placed on an upper surface of the tablet housing section and which functions to support an operation of feeding the tablets into the tablet housing chambers in accordance with dosaging times per day at the second position, at least one indicating section for visually indicating information on the dosaging times, the indicating section being formed on the manual distribution support member so as to be adjacent to corresponding tablet housing chambers when the manual distribution support member is at the second position, a first sensor arranged at the rotation supporting mechanism, the first sensor being in an ON state when detecting the manual distribution supporting member is at the second position, and an OFF state when detecting the manual distribution supporting member is at the first position, and a second sensor arranged at the rotation supporting mechanism, the second sensor being in an OFF state when detecting the manual distribution supporting member is at the second position, and an ON state when detecting the manual distribution supporting member is at the first position.

2. The medicine packaging apparatus according to claim 1, wherein the tablet housing section further comprises a control section which inhibits the medicine discharge section from starting an operation when both of the first and second sensors are in the ON state, or both of the first and second sensors are in the OFF state.

3. The medicine packaging apparatus according to claim 1, wherein the upper end openings of all of the tablet housing chambers are open when the manual distribution supporting member is at the first position, and the upper end openings of the tablet housing chambers in one or more rows of the tablet housing chambers on a rear side of the tablet housing chambers are closed when the manual distribution supporting member is at the second position.

4. The medicine packaging apparatus according to claim 3, wherein the tablet housing chambers are arranged in four rows in the anteroposterior direction, and wherein the manual distribution supporting member closes the upper end openings of the tablet housing chambers in the rearmost-side row among the four rows at the second position.

5. The medicine packaging apparatus according to claim 1, wherein the manual distribution supporting member comprises:

a plurality of opening portions which are respectively communicated with the upper end openings of the tablet housing chambers so as to permit passage of the tablets when the manual distribution supporting member is at the second position, wherein the indicating sections are respectively provided adjacent to the respective opening sections.

6. The medicine packaging apparatus according to claim 5, wherein each of the indicating sections indicates the dosaging times by colors, patterns, symbols, letters, numbers, or combinations of two or more of them.

7. The medicine packaging apparatus according to claim 5, wherein the manual distribution supporting member includes at least first and second manual distribution supporting members, wherein the first manual distribution supporting member has three kinds of the indicating sections corresponding to a three times daily dosage, and wherein the second manual distribution supporting member has four kinds of the indicating sections corresponding to a four times daily dosage.

8. The medicine packaging apparatus according to claim 1, wherein the tablet housing section comprises a plurality of first partition walls for partitioning the tablet housing chambers in a column direction, and a plurality of second partition walls for partitioning the tablet housing chambers in a row direction, wherein the tablet housing chambers respectively comprises lower end openings on opposite sides relative to the upper end openings, wherein the medicine discharge section comprises a first shutter plate arranged under the tablet housing section and a second shutter plate arranged under the first shutter plate as superimposed thereon, wherein a plurality of tablet passage holes respectively corresponding to the tablet housing chambers are formed in the first and second shutter plates, the tablet passage holes being defined by first partition sections extending in the row direction of the tablet housing chambers and second partition sections extending in the column direction of the tablet housing chambers, and wherein the first and second shutter plates are movable in the column direction of the tablet housing chambers between a retaining position and an open position, displacement to the retaining position causing the lower end openings of the tablet housing chambers to be respectively closed by the first partition sections of the first shutter plate or the first partition sections of the second shutter plate, displacement to the open position causing the first partition sections of the first shutter plate to recede to lower sides of the first partition walls of the tablet housing section and the first partition sections of the second shutter to recede to lower sides of the first partition sections of the first shutter plate, with the result that the tablet passage holes of the first and second shutter plates are opposed to the lower end openings of the respective tablet housing chambers.

* * * * *

UNITED STATES PATENT AND TRADEMARK OFFICE

CERTIFICATE OF CORRECTION

PATENT NO. : 8,584,434 B2
APPLICATION NO. : 12/311068
DATED : November 19, 2013
INVENTOR(S) : Kodama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 334 days.

Signed and Sealed this
Fourteenth Day of April, 2015

Michelle K. Lee

Michelle K. Lee
*Director of the United States Patent and Trademark Office*